US005536902A

United States Patent [19]

Serra et al.

[11] Patent Number: 5,536,902

[45] Date of Patent: Jul. 16, 1996

[54] METHOD OF AND APPARATUS FOR ANALYZING AND SYNTHESIZING A SOUND BY EXTRACTING AND CONTROLLING A SOUND PARAMETER

[75] Inventors: Xavier Serra, Barcelona, Spain; Chris Williams, San Rafael, Calif.; Robert Gross, Raleigh, N.C.; Erling Wold, El Cerrito, Calif.

[73] Assignee: Yamaha Corporation, Japan

[21] Appl. No.: 48,261

[22] Filed: Apr. 14, 1993

[51] Int. Cl.[6] ..... G10H 7/00; G10H 1/06

[52] U.S. Cl. ..... 84/623; 84/627

[58] Field of Search ..... 84/622, 623, 625, 84/627, 659–661, 663, DIG. 9

[56] References Cited

U.S. PATENT DOCUMENTS

| | | | |
|---|---|---|---|
| 4,446,770 | 5/1984 | Bass . | |
| 4,611,522 | 9/1986 | Hideo . | |
| 5,210,366 | 5/1993 | Sykes, Jr. | 84/616 |
| 5,401,897 | 3/1995 | Depalle et al. | 84/625 |
| 5,412,152 | 5/1995 | Kageyama et al. | 84/607 |

OTHER PUBLICATIONS

"A System For Sound Analysis/Transformation/Synthesis Based On A Deterministic Plus Stochastic Decomposition", Serra, Oct. 1989.

*Primary Examiner*—William M. Shoop, Jr.
*Assistant Examiner*—Jeffrey W. Donels
*Attorney, Agent, or Firm*—Graham & James

[57] ABSTRACT

Analysis data are provided which are indicative of plural components making up an original sound waveform. The analysis data are analyzed to obtain a characteristic concerning a predetermined element, and then data indicative of the obtained characteristic is extracted as a sound or musical parameter. The characteristic corresponding to the extracted musical parameter is removed from the analysis data, and the original sound waveform is represented by a combination of the thus-modified analysis data and the musical parameter. These data are stored in a memory. The user can variably control the musical parameter. A characteristic corresponding to the controlled musical parameter is added to the analysis data. In this manner, a sound waveform is synthesized on the basis of the analysis data to which the controlled characteristic has been added. In such a sound synthesis technique of the analysis type, it is allowed to apply free controls to various sound elements such as a formant and a vibrato.

51 Claims, 20 Drawing Sheets

VIBRATO ANALYSIS SYSTEM

VIBRATO SYNTHESIS

TIME MODIFICATION ALGORITHM

METHOD OF AND APPARATUS FOR ANALYZING AND SYNTHESIZING A SOUND BY EXTRACTING AND CONTROLLING A SOUND PARAMETER

BACKGROUND OF THE INVENTION

The present invention generally relates to a method of and an apparatus for analyzing and synthesizing a sound, and more particularly to various improvements for a musical synthesizer employing a spectral modeling synthesis technique.

A prior art musical synthesizer employing a spectral modeling synthesis technique (hereafter referred to as is disclosed in "A System for Sound Analysis/Transformation/Synthesis based on a Deterministic plus Stochastic Decomposition" Ph. D. Dissertation, Stanford University, written by Xavier Serra, one of the co-inventors of the present application and published in October, 1989. Such a prior musical synthesizer is also disclosed in U.S. Pat. No. 5,029,509 describing an invention by Xavier Serra entitled "Musical Synthesizer Combining Deterministic and Stochastic Waveforms", as well as in PCT International Publication No. W090/13887 corresponding to this U.S. Patent.

The SMS technique is a musical sound analysis/synthesis technique utilizing a model which assumes that a sound is composed of two types of components, namely, a deterministic component and a stochastic component. The deterministic component is represented by a series of sinusoids and has amplitude and magnitude functions for each sinusoid; that is, the deterministic component is a spectral component having deterministic amplitudes and frequencies. The stochastic component is, on the other hand, represented by magnitude spectral envelopes. The stochastic component is, for example, defined as residual spectra represented in spectral envelopes which are obtained by subtracting the deterministic spectra from the spectra of an original waveform. The sound analysis/synthesis is performed for each time frame during a sequence of time frames.

Analyzed data for each time frame is represented by a set of sound partials each having a specific frequency value and a specific amplitude value as follows:

an (ι), fn(ι) for $$n=0, \ldots, N-1$$

em(ι) for $$m=0, \ldots, M-1 \qquad \text{(Expression 1)}$$

where f represents a specific frame, an(ι) and fn(ι) represent the amplitude and frequency, respectively, of every sound partial (in this specification, also referred to as "partial") at frame ι which correspond to deterministic component. N is the number of sound partials at that frame. em(ι) represents a spectral envelope corresponding to the stochastic component, m is the breakpoint number, and M is the number of breakpoints at that frame.

Such a musical sound synthesis based on the SMS technique is advantageous in that it can synthesize a sound waveform of extremely high quality by the use of compressed analysis data. Further, it has a potentiality to create a wide variety of new sounds in response to the user's free controls over the analysis data used for the sound synthesis. Therefore, in the musical sound synthesis based on the SMS technique, there has been an increasing demand for establishing a concrete method applicable to various musical controls.

A technique is also well-known in the art which obtains spectral data of sound partials by analyzing an original sound waveform by means of the Fourier transformation or other suitable technique, stores the obtained spectral data in a memory, and then synthesizes a sound waveform by the inverse-Fourier transformation of the sound partial spectral data as read out from the memory. However, the conventionally-known sound partial synthesis technique is nothing but a mere synthesis technique and never employs an analytical approach for controlling the musical characteristics of a sound to be synthesized.

One of the technical problems encountered in the prior art music synthesizers is how to synthesize human voice. Many of the conventionally-known techniques for synthesizing vocal sounds are based on a vocal model; that is, they are based on passing an excitation signal through a time-varying filter. However, such a model can not generate a high-quality sound and has a poor flexibility. Further, the majority of the prior art vocal sound synthesis techniques are not based on analysis but a mere synthesis technique. In other words, they can not model a given singer. Moreover, the prior art techniques provided no method for removing a vibrato from recorded singer's voice.

SUMMARY OF THE INVENTION

Therefore, it is an object of the present invention to allow better or improved sound controls by employing an analytical approach for controlling musical characteristics of a sound to be synthesized, in a musical sound synthesis technique or a sound partial synthesis technique based on the SMS technique or any other analytical sound synthesis technique.

It is another object of the present invention to propose various improvements for a sound analysis/synthesis based on the SMS technique in order to enhance the practicability of the analysis/synthesis.

It is still another object of the present invention to provide a technique for extracting a formant characteristic from analysis data of an original sound waveform and controlling the extracted characteristic for use in a sound waveform synthesis.

It is still another object of the present invention to provide a technique for extracting a vibrato or tremolo characteristic from analysis data of an original sound waveform and controlling the extracted characteristic for use in a sound waveform synthesis.

It is still another object of the present invention to provide a technique for extracting a spectral tilt characteristic from analysis data of an original sound waveform and controlling the extracted characteristic for use in a sound waveform synthesis.

It is still another object of the present invention to provide a technique for extracting a pitch from analysis data of an original sound waveform and controlling the extracted pitch for use in a synthesis of a sound waveform having a variably controlled pitch.

It is still another object of the present invention to provide a technique for extracting a specific waveform segment by detecting a vibrato-like low-frequency variation from analysis data of an original sound waveform and controlling the extracted waveform segment for use in a synthesis of a sound waveform having an extended or shortened duration.

It is still another object of the present invention to provide a novel sound synthesis technique which combines the SMS technique and the digital waveguide technique.

It is still another object of the present invention to propose a synthesis of a high-quality vocal phrase sound with an analytical approach employing the SMS technique.

In order to achieve one of the above-mentioned objects, a method of analyzing and synthesizing a sound according to the present invention comprises a first step of providing analysis data based on an analysis of an original sound, said analysis data being indicative of plural components making up a waveform of the original sound, a second step of analyzing, from said the analysis data, a characteristic concerning a predetermined sound element so as to extract data indicative of the analyzed characteristic as a sound parameter, the extracted sound parameter denoting a peculiar property concerning said element in the original sound, a third step of removing from said analysis data the characteristic corresponding to said extracted sound parameter, a fourth step of adding the characteristic corresponding to said sound parameter to said analysis data from which said characteristic has been removed, and a fifth step of synthesizing a sound waveform on the basis of said analysis data to which said characteristic has been added.

According to the above-mentioned arrangement, because a characteristic concerning a predetermined element is analyzed from the analysis data of the original sound, it is allowed to obtain a good-quality sound parameter indicative of the original characteristic concerning various elements such as a formant and a vibrato. Therefore, by utilizing this parameter in synthesizing a sound waveform, it is allowed to synthesize various sound characteristics of good quality. In addition, being separately extracted from the analysis data, the sound parameter is very easy to variably control and is also very suitable for unconstrained musical controls by the user. Further, because the characteristic corresponding to the extracted sound parameter is removed from the analysis data, the structure of the analysis data can be simplified to such a degree that a substantial data compression can be achieved. In this manner, various advantages can be achieved by this technique which is characterized in synthesizing a sound waveform by extracting the sound parameter from the analysis data, providing data representative of the original sound waveform by a combination of the analysis data from which the sound parameter corresponding characteristic has been removed and the sound parameter.

In order to achieve another one of the objects, a method of analyzing a sound according to the invention comprises a first step of providing analysis data based on an original sound, said analysis data being indicative of plural components making up a waveform of the original sound, a second step of analyzing, from said the analysis data, a characteristic concerning a predetermined sound element so as to extract data indicative of the analyzed characteristic as a sound parameter, the extracted sound parameter denoting a peculiar property concerning said element in the original sound, and a third step of removing from said analysis data the characteristic corresponding to said extracted parameter, the waveform of the original sound being represented by a combination of said analysis data from which said characteristic has been removed and said sound parameter.

In order to achieve a similar object, a method of analyzing and synthesizing a sound according to the present invention comprises a first step of providing analysis data based on an analysis of an original sound, said analysis data being indicative of plural components making up a waveform of the original sound, a second step of analyzing, from said the analysis data, a characteristic concerning a predetermined sound element so as to extract data indicative of the analyzed characteristic as a sound parameter, the extracted sound parameter denoting a peculiar property concerning said element in the original sound, a third step of modifying said sound parameter, a fourth step of adding the characteristic corresponding to said sound parameter to said analysis data, and a fifth step of synthesizing a sound waveform on the basis of said analysis data to which said characteristic has been added.

In order to achieve still another one of the above-mentioned objects, a sound waveform synthesizer according to the present invention comprises an analyzer section for providing analysis data indicative of plural components making up a waveform of an original sound, said analysis data being obtained from an analysis of the original sound, a data processing section for analyzing, from the analysis data, a characteristic concerning a predetermined element so as to extract data indicative of the analyzed characteristic as a sound parameter, and removing from said analysis data the characteristic corresponding to the extracted sound parameter, a storage section for storing said analysis data from which said characteristic has been removed and said sound parameter, a data reproduction section for reading out said analysis data and said sound parameter from said storage section and adding to the read-out analysis data said characteristic corresponding to the sound parameter, and a sound synthesizer section for synthesizing a sound waveform on the basis of said analysis data reproduced in said data reproduction section.

In order to achieve still another one of the above-mentioned objects, a sound waveform synthesizer according to the present invention comprises a storage section for storing waveform analysis data containing data indicative of sound partials, and a sound parameter indicative of a characteristic concerning a predetermined sound element extracted from an original sound, a readout section for reading out said waveform analysis data and said sound parameter from said storage section, a control section for performing a control to modify the sound parameter read out from said readout section, a data modification section for modifying the read-out waveform data with the controlled sound parameter, and a sound synthesizer section for synthesizing a sound waveform on the basis of the waveform analysis data modified by said data modification section.

In order to achieve still another one of the objects, a sound waveform synthesizer according to the present invention comprises a first section for providing spectral analysis data obtained from a spectral analysis of an original sound, a second section for detecting a formant structure from said spectral analysis data to thereby generate parameters describing the detected formant structure, and a third section for subtracting the detected formant structure from said spectral analysis data to thereby generate residual spectral data, a waveform of an original sound being represented by a combination of said residual spectral data and said parameters.

The above-mentioned sound waveform synthesizer may further comprises a fourth section for variably controlling said parameters in order to control the formant, a fifth section for reproducing a formant structure on the basis of said parameters and adding the reproduced formant structure to the residual spectral data to thereby make completed spectral data having a controlled formant structure, and a sound synthesizer section for synthesizing a sound waveform on the basis of the spectral data made by the fifth section.

In order to achieve another one of the objects, a sound waveform synthesizer according to the present invention comprises a first section for providing a set of partial data indicative of plural sound portions obtained by an analysis of an original sound, each of the partial data containing frequency data, said set of partial data being provided in time functions, a second section for detecting a vibrato in the original sound from the time functions of the frequency data in the partial data to thereby generate parameters describing the detected vibrato, and a third section for removing a characteristic of the detected vibrato from the time functions of the frequency data in the partial data so as to generate time functions of modified frequency data, a time-varying waveform of the original sound being represented by a combination of the partial data containing the time functions of the modified frequency data and the parameters.

The sound waveform synthesizer may further comprises a fourth section for variably controlling said parameters in order to control the vibrato, a fifth section for generating a vibrato function on the basis of said parameters and utilizing the generated vibrato function to impart a vibrato to the time functions of the modified frequency data, and a sound synthesizer section for synthesizing a sound waveform being synthesized on the basis of the partial data containing the time functions of the frequency data to which the vibrato has been imparted.

In the above-mentioned synthesizer, a tremolo in the original sound may be detected from the magnitude data time functions in the partial data so as to perform a process similar to the case of vibrato, so that it is possible to extract and variably control a tremolo and to synthesize a sound waveform on the basis of such a control.

In order to achieve still another one of the objects, a sound waveform synthesizer according to the present invention comprises a first section for providing spectral data indicative of a spectral structure of an original sound, a second section for, on the basis of said spectral data, detecting only one tilt line that substantially corresponds to an spectral envelope of the spectral data and generating a tilt parameter describing the detected tilt line, a third section for variably controlling said tilt parameter in order to control a spectral tilt, a fourth section for controlling the spectral structure of the spectral data on the basis of the controlled tilt parameter, and a sound synthesis section for synthesizing a sound waveform on the basis of the spectral data.

In order to achieve still another one of the objects, a sound waveform synthesizer according to the present invention comprises a first section for providing spectral data of partials making up an original sound, said spectral data of the partials being provided in correspondence to plural time frames, a second section for detecting an average pitch of the original sound on the basis of frequency data in the spectral data of the partials in a series of the time frames, to thereby generate pitch data, a third section for variably controlling said pitch data, a fourth section for modifying the frequency data of the spectral data of the partials in accordance with the modified pitch data, and a sound synthesizer section for synthesizing a sound waveform having the variably controlled pitch on the basis of the spectral data of the partials containing the modified frequency data.

In order to achieve still another one of the objects, a method of analyzing and synthesizing a sound according to the present invention comprises the steps of providing spectral data of partials making up an original waveform in series corresponding to plural time frames, detecting a vibrato variation in said original waveform from a spectral data series of plural time frames and thereby making a data list that points out one or more waveform segments having a duration corresponding to at least one cycle of the vibrato variation, selecting a desired waveform segment with reference to said data list, extracting a spectral data series corresponding to the selected waveform segment, from said spectral data series of the original waveform, repeating the extracted spectral data series and thereby making a spectral data series corresponding to repetition of the waveform segment, and synthesizing a sound waveform having an extended duration utilizing the spectral data series corresponding to said repetition.

The above-mentioned method may further comprises the steps of providing, in series corresponding to the plural time frames, stochastic data corresponding to a residual component waveform that is a result of subtracting from said original waveform a deterministic component waveform corresponding to said spectral data of the partials, extracting a stochastic data series corresponding to said selected waveform segment, from a stochastic data series of said original waveform, repeating the extracted stochastic data series and thereby making a stochastic data series corresponding to repetition of the waveform segment, and synthesizing a sound waveform having an extended duration utilizing the stochastic data series corresponding to said repetition, and incorporating the synthesized stochastic waveform into said sound waveform.

In order to still another one of the objects, a method of analyzing and synthesizing a sound according to the present invention comprises the steps of providing spectral data of partials making up an original waveform in series corresponding to plural time frames, detecting a vibrato variation in said original waveform from a spectral data series of the plural time frames and thereby making a data list that points out one or more waveform segments having a duration corresponding to at least one cycle of the vibrato variation, selecting a desired waveform segment with reference to said data list, removing a spectral data series corresponding to the selected waveform segment, from a spectral data series of the original waveform and connecting two spectral data series which remain before and after the removed spectral data series to thereby make a shortened spectral data series, and synthesizing a sound waveform having a shortened duration, utilizing the shortened spectral data series.

The above-mentioned method may further comprises the steps of providing, in series corresponding to the plural time frames, stochastic data corresponding to a residual component waveform that is a result of subtracting from said original waveform a deterministic component waveform corresponding to said spectral data of the partials, removing a stochastic data series corresponding to the selected waveform segment, from a stochastic data series of the original waveform and connecting two stochastic data series which remain before and after the removed series to thereby make a shortened stochastic data series, and synthesizing a stochastic waveform having a shortened duration utilizing the shortened stochastic data series, and incorporating the synthesized stochastic waveform into said sound waveform.

Detailed description on preferred embodiments of the present invention will be made below with reference to the accompanying drawings.

PREFERRED EMBODIMENTS OF THE INVENTION

<General Description>

Figure 1:
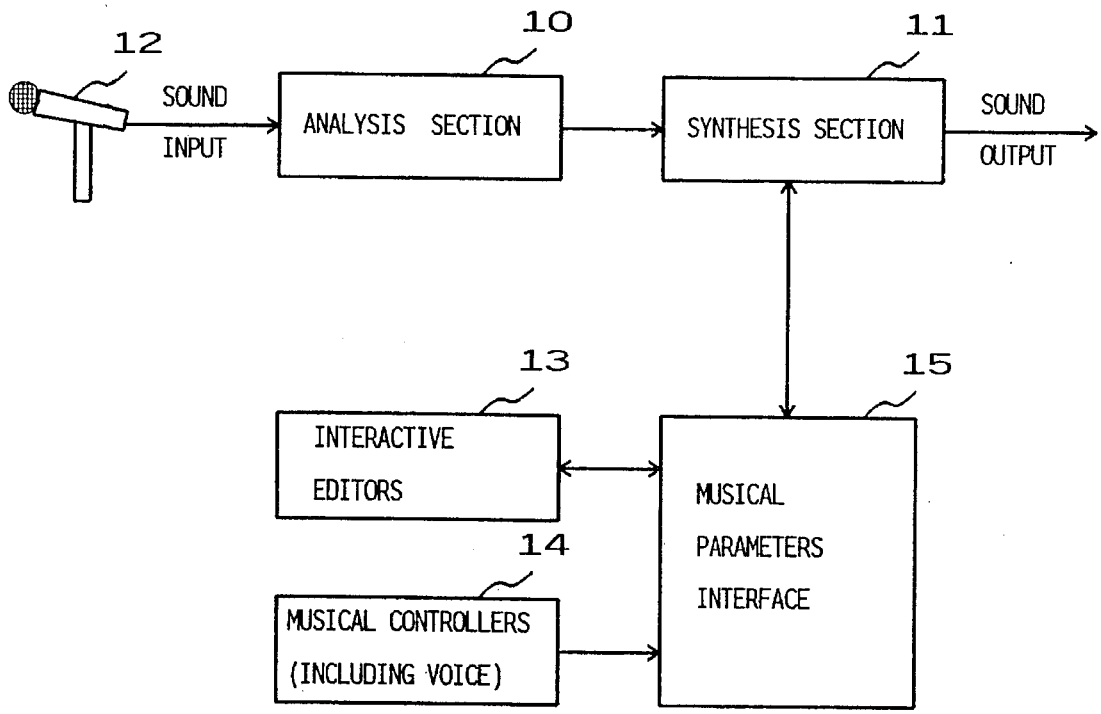
FIG. 1 is a block diagram illustrating a music synthesizer in accordance with an embodiment of the present invention.

FIG. 1 is a general diagram of a music synthesizer in accordance with an embodiment of the invention. The synthesizer generally comprises an analysis section 10 for analyzing an original sound, and a synthesis section 11 for synthesizing a sound from the analyzed representation, namely, analyzed data. The original sound may be picked up from the outside through a microphone 12 and input to the analyzing section 11, or it may be introduced into the analyzing section 11 in any other suitable manner. Both of the analysis and synthesis performed in this music synthesizer are based on the SMS (Spectral Modeling Synthesis) technique, principle of which is described in the above-mentioned U.S. Pat. No. 5,029,509. Alternatively, the analyzed data may be prestored in a memory of the synthesizer, in which case the provision of the analysis section 10 may be optional. This music synthesizer may be constructed as a singing synthesizer which is suitable for analysis and synthesis of singing voices or vocal phrases. However, the present invention is applicable to analysis and synthesis of not only such singing voices but also other sounds in general such as natural musical instruments' tones.

In the embodiments described below, several specific improvements have been made to the traditional SMS analysis. Such improvements are believed to be particularly suitable for the analysis and synthesis of singing voices or vocal phrases, but they may also be advantageously used for the analysis and synthesis of other sounds in general.

According to one of such improvements, a process is performed in the analysis section 10 for extracting, from the SMS analysis data, characteristics concerning predetermined sound elements so as to extract data indicative of the analyzed characteristics as sound parameters; each of the sound parameters will hereafter be referred to as a "musical parameter". The thus-extracted musical parameters are then given to the synthesis section 11 in such a manner that they are manipulated by the user in synthesizing a tone. Namely, in order to modify a sound to be synthesized as desired, the user need not interact with parameters in the form of special SMS analysis data, but instead the user only needs to interact with the musical parameters in such a form corresponding to more familiar conventional musical information, which is very convenient. The musical parameters are, for example, parameters corresponding to various musical elements or tone elements like tone pitch, vibrato, tremolo etc. Therefore, there may be provided interactive editors 13 and musical controllers 14 as shown.

The editors 13 may comprise various computer peripherals (such as an input keyboard, display and mouse) and may also include a removable data memory in the form of a card, cartridge, pack etc. The musical controllers 14 may include, for example, a keyboard for designating desired scale tones, panel switches for selecting or setting desired tone colors, other switches for selecting and/or controlling various tonal effects, and various operating members for performing tone controls in accordance with the user's instructions. The musical controllers 14 may further include controllers for controlling a tone in response to the user's voice, body action or breath. Between the synthesis section 11, and these editors 13 and controllers 14 capable of being manipulated by the user, there is provided a musical parameter interface section 15 for properly performing a parameter exchange therebetween and translation of various information.

Detailed description on a specific example of the music synthesizer will be made below with reference to various figures starting with FIG. 2, most of which figures illustrate details of the individual components in functional blocks. The illustrated functions may be achieved either by discrete circuits or by software processings using a microcomputer. Further, it should be noted that this synthesizer need not have all the functions associated with the several improvements to be described later; instead it may be sufficient for the synthesizer to have only one of the functions as the case may demand.

<Description on Analysis Section>

Figure 2:
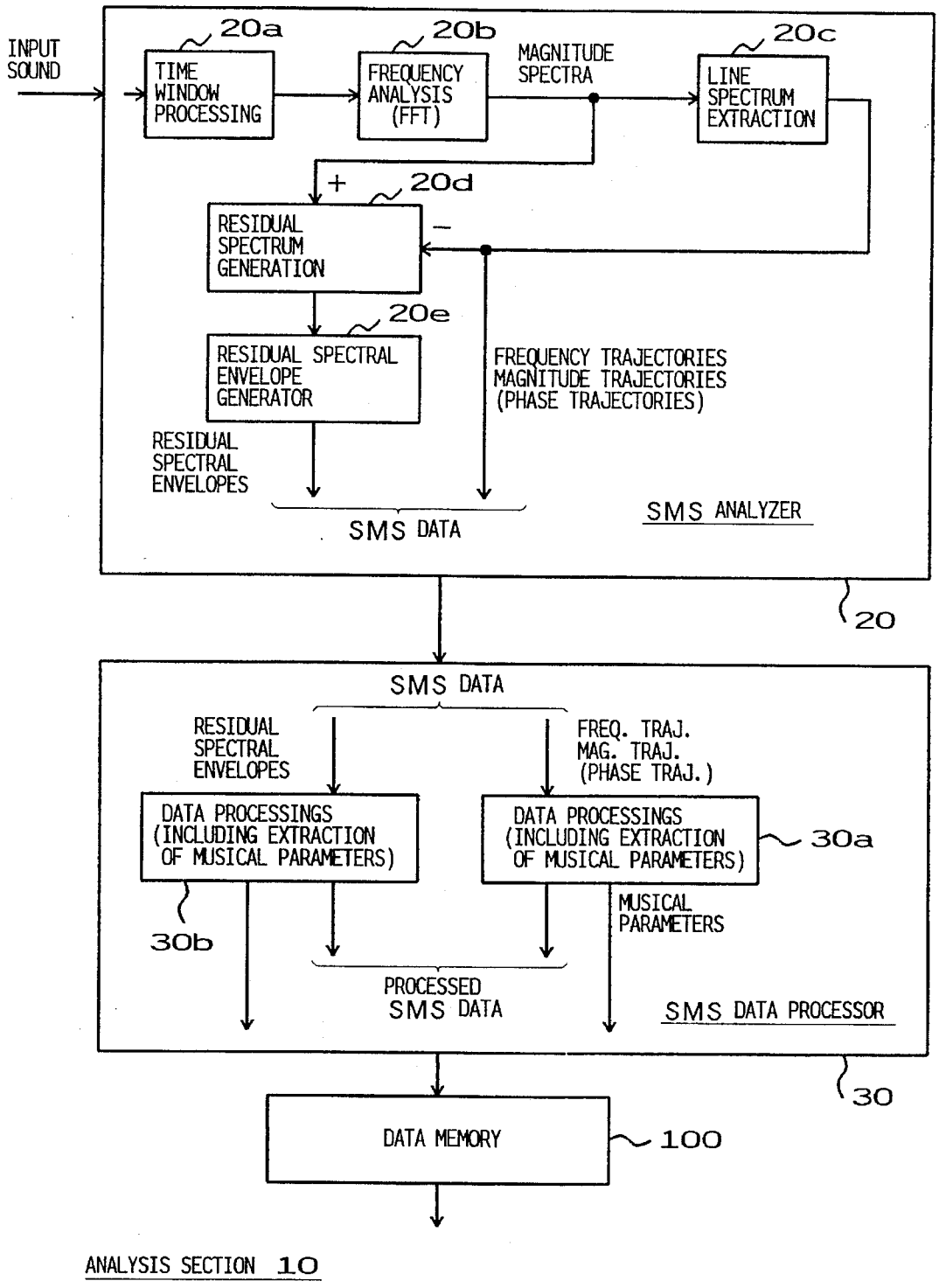
FIG. 2 is a block diagram illustrating an embodiment of an analysis section shown in FIG. 1.

FIG. 2 is a block diagram illustrating an example of the analysis section 11. An SMS analyzer 20 to which an original sound signal is input performs an SMS analysis of the original sound in accordance with the SMS analysis technique as disclosed in the above-mentioned U.S. Pat. No. 5,029,509. The fundamental structure of the SMS analyzer 20 may be understood from the one as illustrated in FIG. 1 of the above-mentioned U.S. Patent. For convenience of understanding, an example of the fundamental structure of the SMS analyzer 20 is schematically shown in block 20 of FIG. 2.

SMS Analyzer

In the SMS analyzer 20, the input sound signal is first applied to a time window processing section 20*a*, in which the sound signal is broken into a series of frames or time frames which may also be called "time windows". A frequency analysis section 20*b* following the time window processing section 20*a* analyzes the sound signal of every frame to thereby generate a set of magnitude spectral data. For example, a set of complex spectra may be generated by the analysis of a fast Fourier Transformer (FFT) and then converted by an unillustrated complex-to-real-number converter into magnitude spectra, or alternatively any other suitable frequency analysis may be employed.

A line spectrum extraction section 20*c* extracts line spectra of sound partials from a set of magnitude spectra of the analyzed original sound. For example, detection is made of peaks in the set of magnitude spectra of the analyzed original sound, and spectra having specific frequency values and amplitude, i.e, magnitude values corresponding to detected peaks are extracted as line spectra. These extracted line spectra correspond to the deterministic components of the sound. Each of the extracted line spectra, i.e., each deterministic component may be composed of pairs of data, each pair comprising data representative of a specific frequency and its amplitude, namely, magnitude value. Additionally, each of the pairs may include data representative of a phase. The line spectral data of these sound partials are obtained in time series in correspondence to the frames, and sets of such time-series line spectral data are respectively called a frequency trajectory, a magnitude trajectory and a phase trajectory.

For each frame, a residual spectrum generation/calculation section 20*d* subtracts the extracted line spectra from a set of the magnitude spectra so as to generate residual spectra. In this case, as shown in the above-mentioned U.S. Patent, a waveform of the deterministic component may be synthesized on the basis of the extracted line spectra and then reanalyzed to reextract the line spectra, and thence the reextracted line spectra may be subtracted from the set of magnitude spectra.

For each frame, a residual spectral envelope generator 20*e* performs a process for expressing the residual spectra in envelope representation. This residual spectral envelope can be represented in a line segment approximation and can therefore contribute to the promotion of data compression. The residual spectral envelopes generated in correspondence to a series of time frames correspond to the stochastic component.

The frequency and magnitude trajectories (phase trajectory may be included) corresponding to the deterministic component and the residual spectral envelopes corresponding to the stochastic component, which are all obtained in the SMS analyzer 20, will be collectively referred to as "SMS data" in the following description.

Outline on SMS Data Processings

In an SMS processor 30 following the SMS analyzer 20, appropriate processes are applied to the SMS data obtained in the SMS analyzer 20. Such processes generally comprise two major processes, one of which is to properly process the SMS data so as to obtain modified SMS data and the other of which is to extract various musical parameters from the SMS data. In a data processing block 30*a*, the above-mentioned data processes are performed with respect to the frequency and magnitude trajectories (phase trajectory may be included). Another data processing block 30*b* performs the above-mentioned data processes on the residual spectral envelopes that correspond to the stochastic component.

The processed or modified SMS data resulting from the processings in the SMS data processor 30 and various musical parameters are stored in a data memory 100 in correspondence to the frames. Although many processes may be performed in the SMS data processor 30, the processor 30 need not perform all of these processes in carrying out the present invention, but instead it may selectively perform only some of the processes as the case may demand. As for unmodified SMS data, the same data as given from the analyzer 20 will be stored into the data memory 100.

Figure 3:
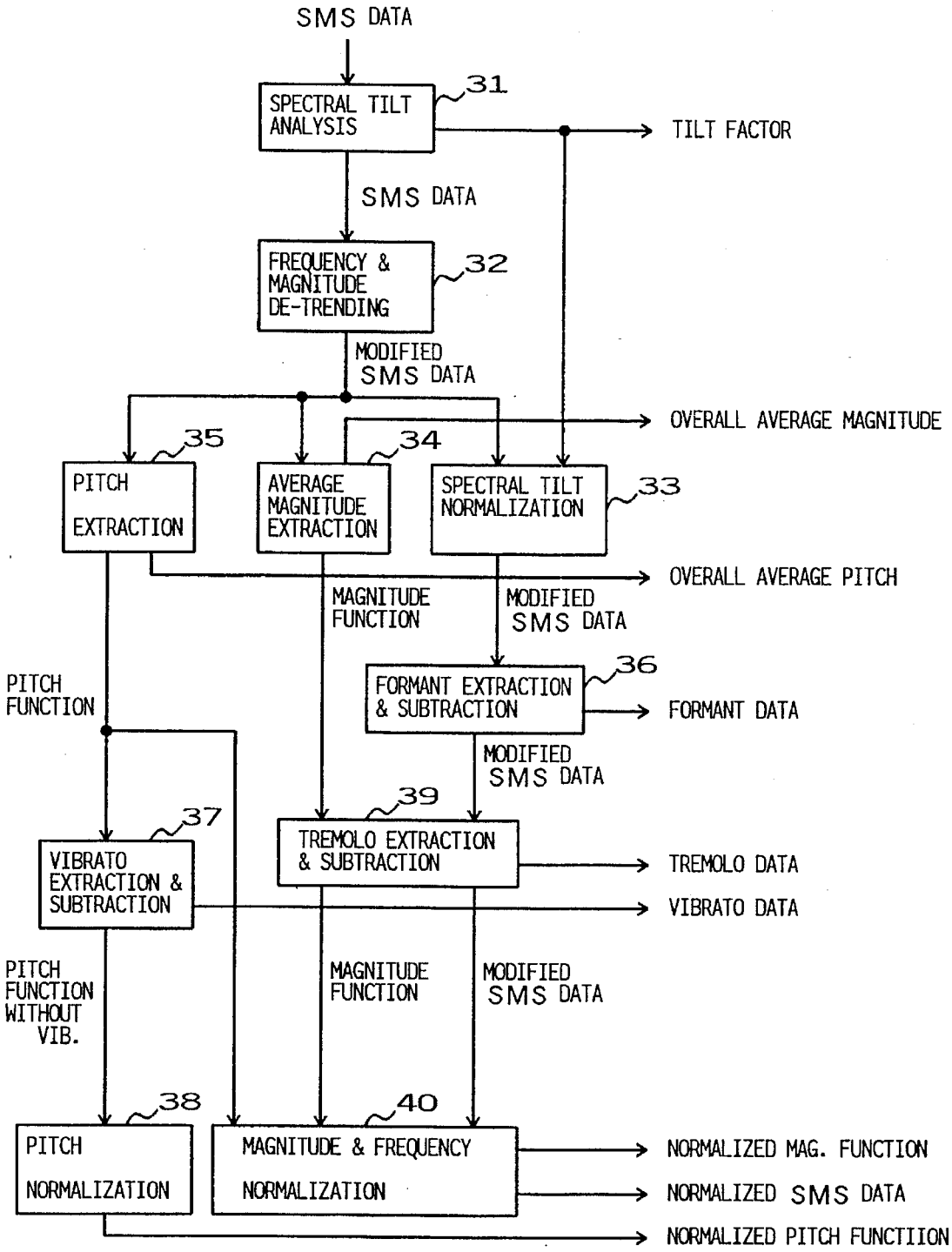
FIG. 3 is a block diagram illustrating an embodiment of an SMS data processor shown in FIG. 2.

Now, various processes performed in the SMS data processor 30 will be outlined with reference to FIG. 3. However, it should be noted that FIG. 3 shows only some representative ones of the processes performed in the SMS data processor 30. As mentioned earlier, it is not necessary to perform all of the processes shown in FIG. 3, and those processes considered unnecessary for carrying out the present invention may be omitted as the case may be. Further, some of the processes not specifically shown in FIG. 3 will be described later in details.

Step 31: Spectral Tilt Analysis

The basic idea of this step is to find the correlation between the magnitude and the spectral tilt. Here, the term "tilt" represents the overall slope of a spectrum. In other words, the tilt is the slope of line connecting the tops of harmonic peaks. Typically, a smaller spectral tilt in a musical sound causes the amplitudes of higher harmonics to be increased, resulting in a brighter sound. This spectral tilt analysis process obtains a single numerical data called a "tilt factor" which expresses the correlation between the magnitude and the spectral tilt. This tilt factor is obtained for each frame, and the thus-obtained tilt factor for each frame will be used later in a "spectral tilt normalization" step that is intended for obtaining a single tilt factor common to all frames.

The tilt factor can be said to be a kind of musical parameter. Thus, if the user freely controls one tilt factor, the characteristics of a sound synthesized in accordance with the SMS technique can be freely controlled to accurately reflect the user's intention.

Step 32: Frequency and Magnitude De-Trending

Ordinarily, the recorded original sound in its steady state has a volume change such as a crescendo and a decrescendo, or a small pitch change. By the way, as a technique which allows a sound to be reproductively sounded for a time longer than the duration of recorded waveform data, it is known to perform a repetitive sound generation process called a "looping process" during the steady state. In the looping process, if there is a variation in tone volume or pitch in the looped waveform data portion, there will be undesirably caused noticeable discontinuities at the loop points (joint point between repetitions) or noticeable unnatural periodicity. In order to provide a solution to this problem, the detrending process removes such a variation so that the general trend in the steady state of the sound is flattened as much as possible. However, the vibrato and micro-variation of the sound are left unremoved.

Step 33: Spectral Tilt Normalization

In this step, a single tilt factor common to all frames is obtained by the use of the tilt factor obtained for each frame. The result is that the tilt factor which is one of the objects to be controlled by the user is unified irrespective of the frames, and therefore enhanced controllability is effectively achieved.

Step 34: Average Magnitude Extraction

This is a step in which the average magnitude value of all the deterministic signals is computed for each frame. That is, for each frame, the magnitude values of all the partials are added up and the resulting total value is divided by the number of partials. The thus-obtained average magnitude for each frame will be referred to as a "magnitude function". This magnitude function shows time-varying tone volume of the sound represented by the deterministic component. In addition, the overall average magnitude is computed from the average magnitude of each frame, only for the steady state of the sound. The overall average magnitude thus indicates a representative tone volume level of the sound in its steady state.

Step 35: Pitch Extraction

This is a step in which the pitch of every frame is computed. For each frame, this is done by using the first few, namely, lower-order partials in the SMS data and computing an weighted average pitch. For weighting, the magnitude value of each partial is used as the weight factor. The thus-obtained average pitch is called the pitch of the sound for that frame. The average pitch obtained for each frame will hereafter be referred to as a pitch function. This pitch function is representative of time-varying pitch of the sound which is represented by the deterministic component. In addition, the overall average pitch is computed from the average pitch obtained for each frame. The overall average pitch is calculated only for the steady state of the sound and thus indicates a representative pitch of the sound in its steady state. Step 36: Formant Extraction and Subtraction The basic idea of this process is to extract formants from the SMS data and to then subtract the extracted formant from the SMS data. Consequently, all the partials of the resultant modified SMS data have a similar magnitude value. In other words, the spectral shape are flattened. Formant data representative of the extracted formants will be used in the subsequent synthesis stage.

The formant data can also be said to be a kind of musical parameter. If the user freely controls the formant data, the characteristics of a sound synthesized in accordance with the present SMS technique can be freely controlled to accurately reflect the user's intention.

Step 37: Extraction and Subtraction

This is a process in which a vibrato-imparted portion is extracted from the pitch function obtained in the above-mentioned step 35, and the extracted vibrato component is subtracted from the pitch function. Vibrato data representative of the extracted vibrato will be used in the subsequent synthesis stage. The vibrato data can also be said to be a kind of musical parameter and permits the user to readily control the vibrato.

Step 38:

In this step, the overall average pitch is subtracted from the average pitch of each frame in the vibrato-free pitch function output from the above-mentioned step 37.

Step 39: Tremolo Extraction and Subtraction

In this step, a tremolo-imparted portion is extracted from the magnitude function obtained in the above-mentioned step 34, and the extracted tremolo component is subtracted from the magnitude function. In this manner, there is obtained a magnitude function from which tremolo data and tremolo component have been removed. Also, a tremolo component may be removed from the magnitude trajectory in the SMS data, and likewise a tremolo component may be removed from a stochastic gain (gain in the residual spectral envelope of each frame). The tremolo data can also be said to be a kind of musical parameter and permits the user to readily control the tremolo.

Step 40: Magnitude and Frequency Normalization

In this step, the SMS data are normalized. The frequency data is normalized by dividing the frequency trajectory for every partial, by the pitch function obtained in the above-mentioned step 35 times the partial number. The result is that every partial has a frequency value around 1. On the other hand, the magnitude data is normalized by subtracting the above-mentioned magnitude function from the magnitude trajectory. The stochastic data may be normalized by obtaining an average value of stochastic gains (gain in the residual spectral envelope of each frame) in the steady state and subtracting the average gain from the residual spectral envelope gain of each frame. Normalized SMS data may be obtained in this manner. The magnitude function may also be normalized on the basis of the overall average magnitude, so as to obtain a normalized magnitude function.

The processed, namely, modified or normalized SMS data and various musical parameters which have been obtained through the above-mentioned various processes in the SMS data processor 30 are, as mentioned earlier, stored in corresponding relations to the frames. Because, as previously stated, the above-described various processes are optional for carrying out the present invention, normalized SMS data are stored into the data memory 100 in such a case where a normalization process like that of step 40 has been performed. But only modified SMS data are stored into the data memory 100 in such a case where no normalization process has been performed. Further, in such a case where neither modification nor normalization has been performed, SMS data just as analyzed by the SMS analyzer 20 will be stored into the data memory 100.

<Description on Synthesis Section>

Figure 4:
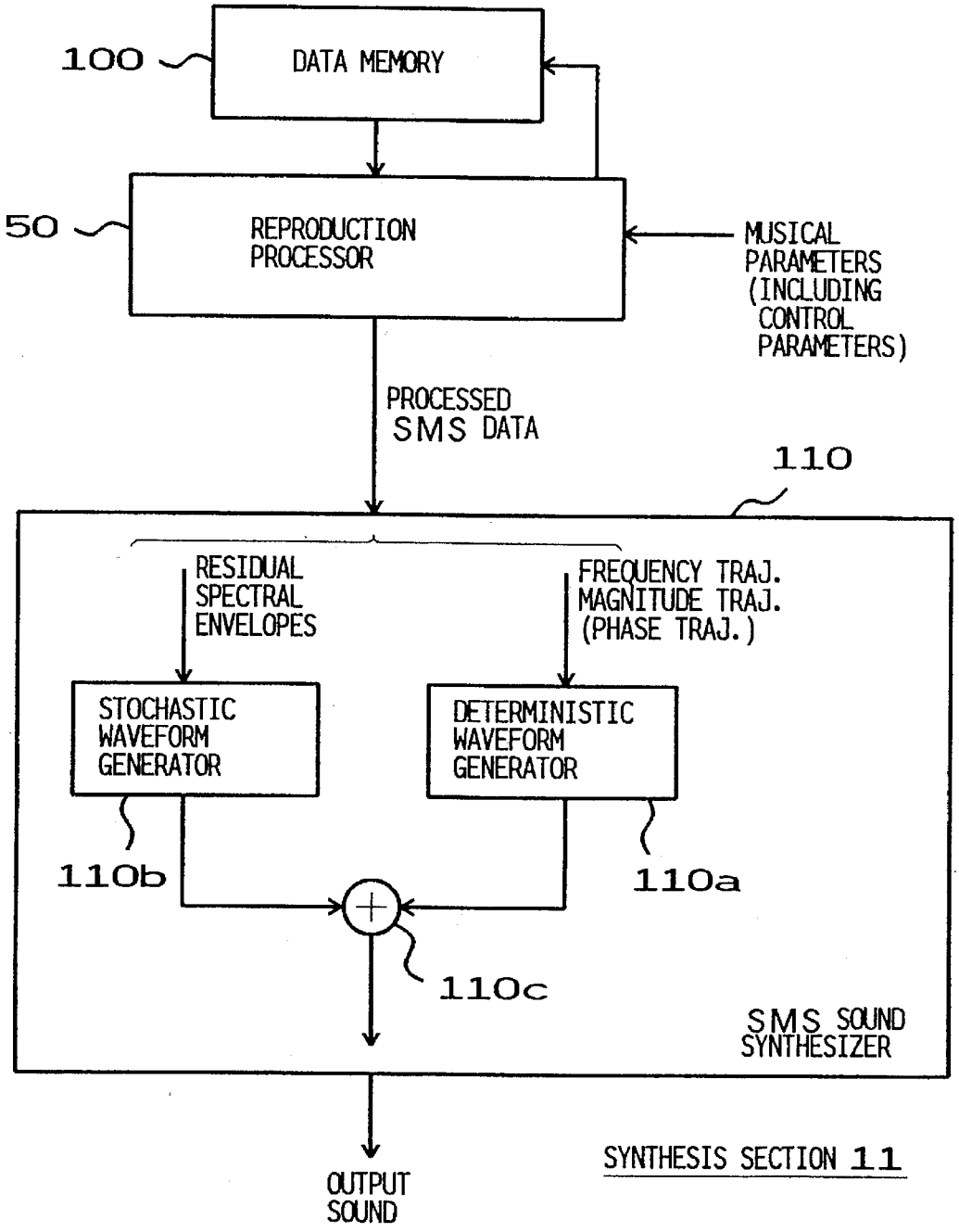
FIG. 4 is a block diagram illustrating an embodiment of a synthesis section shown in FIG. 1.

FIG. 4 is a block diagram illustrating an example of the synthesis section 11 which also utilizes the data memory 100 as that shown in FIG. 2. As mentioned earlier, there are stored in the data memory 100 the processed SMS data of every frame and the extracted various musical parameters. It should be apparent that there may be stored in the data memory 100 these kinds of data which correspond to not only one original sound but also to plural different original sounds.

Figure 11:
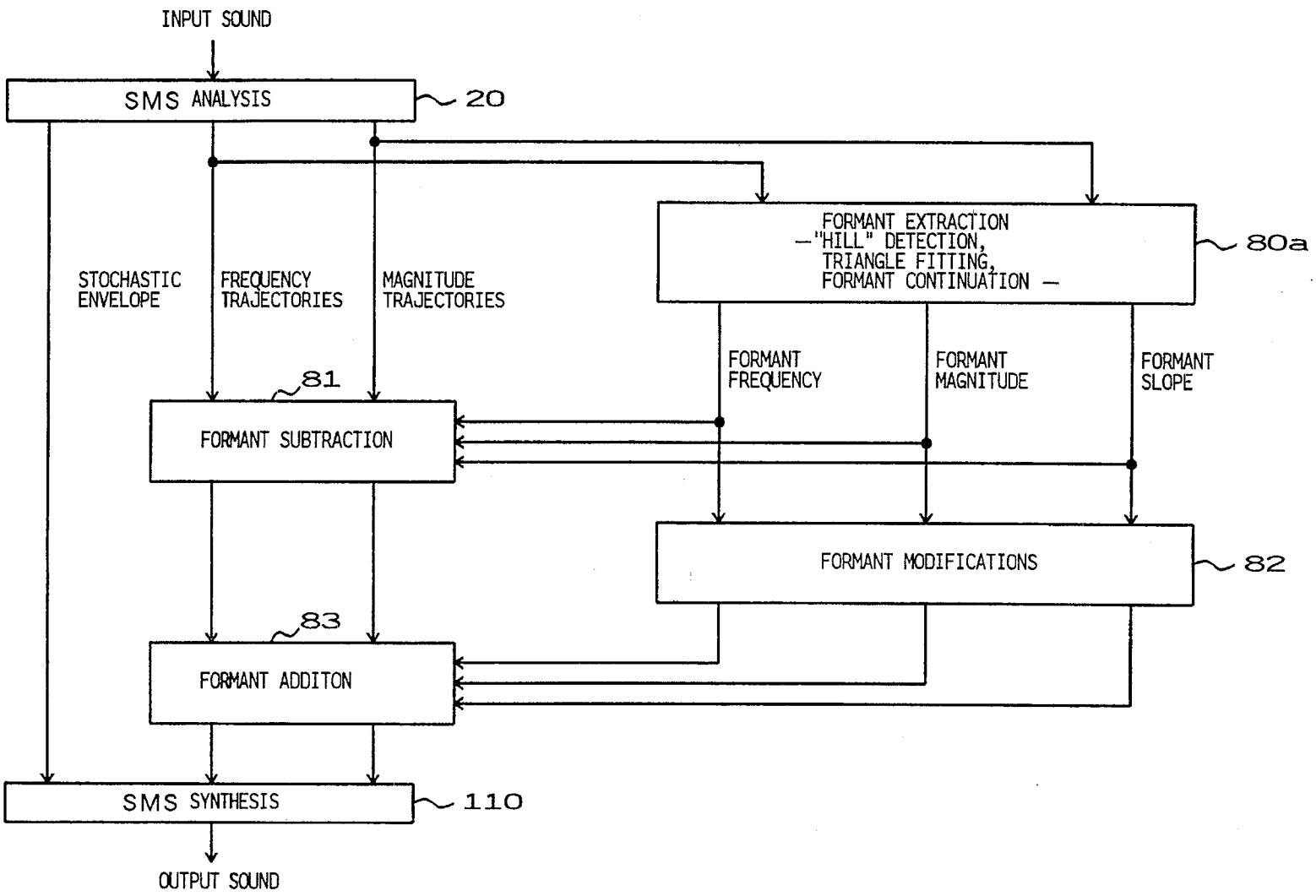
FIG. 11 is a block diagram of another embodiment of the formant extraction/manipulation system in accordance with the present invention.

For reproducing a desired sound, a reproduction processor 50 performs a process of, for reproduction of a desired sound, reading out the stored data from the data memory 100 and various data manipulation processes based on the readout SMS data and musical parameters. The various data manipulation processes will be described in details later. Various musical parameters generated by the editors 13 and the musical controllers 14 shown in FIG. 11 are supplied to this reproduction processor 50 so that various processes in the processor 50 may be performed in accordance with the user controls. When, for example, a desired voice or a tone color is selected by the user, the reproduction processor 50 enables readout from the data memory 100 of a set of data that corresponds to an original sound corresponding to the selected voice and the tone color. Then, when sound-generation-start is instructed by the user, a sequence of frames is caused to starts, so that, of the readout-enabled set of data, the SMS data and various parameters for a specific frame designated by the frame sequence are actually read out from the data memory 100. Thus, the various data manipulation processes are performed on the basis of the read out SMS data and musical parameters, and then the thus-processed SMS data are supplied to an SMS sound synthesizer 110.

On the basis of the supplied SMS data, the SMS sound synthesizer 110 synthesizes a sound in accordance with the SMS synthesis technique as disclosed in the above-mentioned U.S. Pat. No. 5,029,509. For a specific structure of the SMS sound synthesizer 110, reference may be made to, for example, FIGS. 2, 4 or 5 of the U.S. Patent. However, for convenience of explanation, the basic structure of the SMS sound synthesizer 110 is schematically shown by way of example within a block 110. Namely, of the supplied SMS data, the line spectral data (frequency, magnitude and phase) corresponding to the deterministic component is input to a deterministic waveform generator 110*a*, which in turn generates a waveform corresponding to the deterministic component by the use of the Fourier synthesis technique on the basis of the input data. Further, of the supplied SMS data, the residual spectral envelope corresponding to the stochastic component is input to a stochastic waveform generator 110*b*, which in turn generates a stochastic waveform having spectral characteristics corresponding to the spectral envelope. The stochastic waveform generator 110*b* generates such a stochastic waveform by, for example, filtering a noise signal with characteristics corresponding to the residual spectrum envelope. Then, the thus-generated waveform corresponding to the deterministic component and the stochastic waveform are added together by an adder 110*c*, so that a waveform of a desired sound is obtained.

In the reproduction processor 50, it is possible to freely set the pitch of a sound to be synthesized, as desired by the user. That is, when the user designates a desired pitch, the reproduction processor 50 proceeds with a process of modifying the frequency data in the SMS data, so as to allow a sound to be synthesized at the designated desired pitch.

It may be apparent that, in addition to synthesizing only one sound in response to real-time sound generation instructions by the user, the reproduction processor 50 can synthesize a plurality of sounds simultaneously or in a predetermined sequence in accordance with data programmed by the editors 13. Synthesis of a desired vocal phrase can be achieved by the user's real-time sequential entry of control parameters corresponding to the desired vocal phrase or by the user's entry of such control parameters on the basis of programmed data.

Example of Processes in Reproduction Processor

Figure 5:
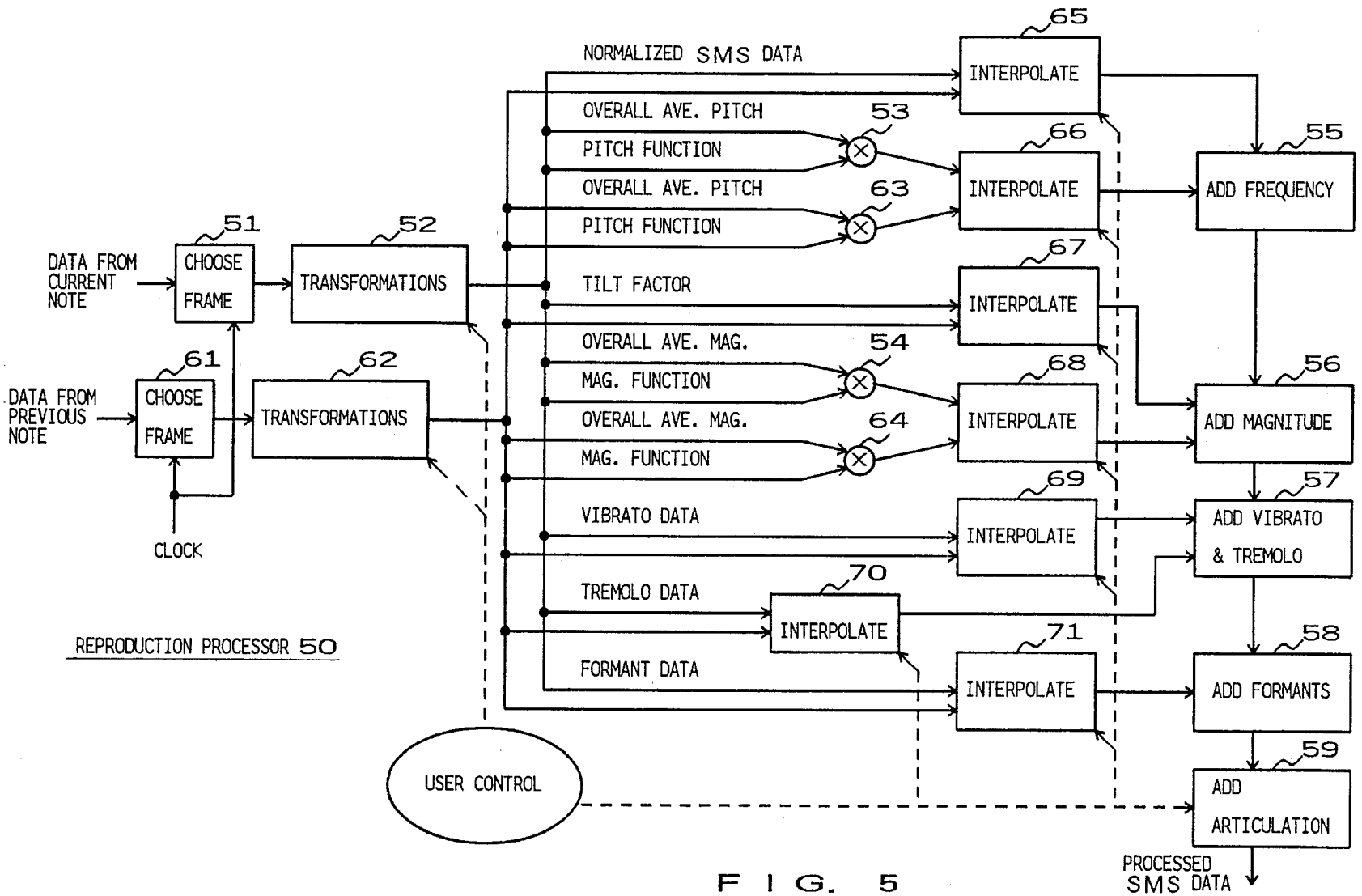
FIG. 5 is a block diagram of an embodiment of a reproduction processor shown in FIG. 4.

Example of various processes performed in the reproduction processor 50 will now be described with reference to FIG. 5. In FIG. 5, all the processes performed in the reproduction processor 50 are not shown but only representative ones of the processes are shown.

Characteristic features of the processes shown in FIG. 5 lie in a data interpolation and in a SMS data reproduction which takes the musical parameters into consideration. It may be apparent that steps associated with the interpolation may be omitted in such a case where no specific data interpolation is performed.

First, description will be made on a case where no specific data interpolation is performed. In that case, steps 51 to 59 of FIG. 5 are made effective. Namely, a only one note is processed which is currently being selected to sound.

Step 51: Choose Frame

In this step, the current frame is designated in accordance with the synthesizer clock, and the data (SMS data and various parameters) corresponding to the designated frame are retrieved from the data memory 100. The algorithm for this frame choosing process may be arranged in such a manner that, in addition to simply advancing the frame in accordance with the synthesizer clock, it allows a return from a loop-end frame to a loop-start frame.

Step 52: Data Transformation

This is a step in which the analysis data (SMS data and musical parameters) for the frame retrieved from the data memory 100 are modified in response to the user controls. For example, when a desired tone pitch is instructed by the user, the frequency data is modified accordingly. Likewise, when a desired vibrato or tremolo is instructed by the user, predetermined musical parameter is modified accordingly. Thus, at every frame, the user has desired controls over every analysis data.

Names of data that are given via this transformation step 52 to steps 53–59 are shown by way of example in FIG. 5.

Step 53:

In this step, the above-mentioned normalized pitch function is computed with the overall average pitch so as to obtain a pitch function from which the normalized state has been cancelled.

Step 54:

This is a step in which the above-mentioned normalized magnitude function is computed with the overall average magnitude so as to obtain a magnitude function from which the normalized state has been cancelled.

Step 55: Add Frequency

This is a step in which the value of the frequency data of the normalized SMS data is released from the normalized state by the use of the pitch function.

Step 56: Add Magnitude

In this step, the value of the magnitude data of the normalized SMS data is released from the normalized state by the use of the magnitude function and the tilt data. As for the case where the residual spectral envelope in the SMS data has been normalized, the spectral envelope is also released from the normalized state in this step.

Step 57: Add Vibrato and Tremolo

In this step, vibrato and tremolo are imparted to the SMS data by the use of the vibrato and tremolo data.

Step 58: Add Formant

In this step, formant is imparted to the SMS data by the use of the formant data.

Step 59: Add Articulation

In this step, a suitable process is performed on the SMS data in order to provide an articulation to a sound to be generated.

Next, description will be made on a data interpolation which permits a smooth note transition when the sound to be generated moves from a certain note (hereafter referred to as a previous note) to another tone (hereafter referred to as a current tone). The data interpolation is useful for, for instance, synthesizing a singing voice. To this end, for an appropriate period at the beginning of the current note, the analysis data (SMS data and various parameters) of the previous note are also retrieved from the data memory 100.

Step 61: Choose Frame

In this step, the data (SMS data and various parameters) at any proper frame of the previous note are retrieved from the data memory 100.

Step 62: Data Transformations

In a similar manner to step 52, the analysis data (SMS data and musical parameters) at the frame retrieved from the data memory 100 are modified in response to the user controls.

Steps 65 to 71: Interpolation

In these steps, for each of the SMS data and parameters, interpolation is made between the data of the previous note and the data of the current note in accordance with predetermined interpolation characteristics. As such interpolation characteristics suitable for this purpose, characteristics may be used which permits a smooth transition from the previous note data to the current note data as in a cross-fade interpolation, but alternatively, any other suitable characteristics may be used. According to this example, various interpolation operation parameters for interpolation steps 65 and 71 can be modified in response to the user controls.

<Detailed Description on Various Data Processing Functions>

Detailed description on various data processing functions will be given below. In the following description, various processes ranging from analysis to synthesis will be explained below for each of the processing functions. Processes in the analysis stage are performed in the SMS data processor 30 (FIGS. 2 and 3), while processes in the synthesis stage are performed in the reproduction processor 50 (FIGS. 4 and 5).

In the following description, each of the data processing functions is described as being applied to the SMS data, but it is also applicable to tone data in any other data format; application of the data processing functions to tone data in all kinds of data formats is within the scope of the present invention as claimed in the appended claims.

Formant Extraction and Manipulation

This function corresponds to the processes of step 37 in FIG. 3 and step 58 in FIG.5. The object of the present invention concerning this function is to extract the formant structure (general spectral characteristics) of a vocal sound from the line spectra of the sound (namely, a set of partials each comprising a pair of frequency and magnitude or amplitude which is the deterministic representation in the SMS data) and to separate the line spectra of the sound into the formant extraction and the residual spectra, so that the analysis data can be compressed to a considerable degree and it is allowed to very easily perform formant modifications or other controls in synthesizing a sound. Because, as is well known, a vocal sound has formants which characterize the sound, this function is extremely useful for the analysis and synthesis of a vocal sound.

Figure 6:
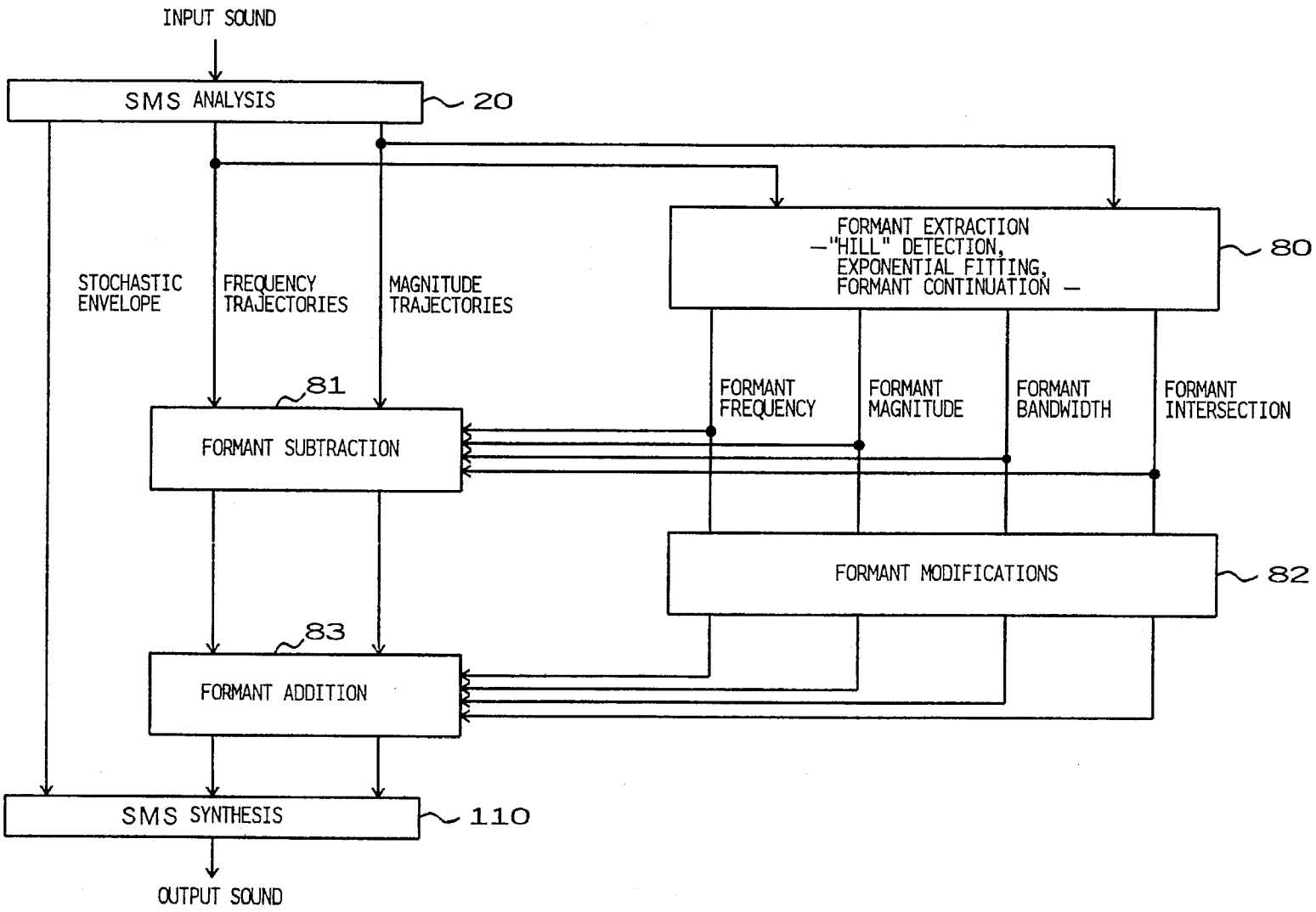
FIG. 6 is a block diagram of an embodiment of a format extraction/manipulation system in accordance with the present invention.

FIG. 6 is a general block diagram of a formant extraction and manipulation system in accordance with this function. An SMS analysis step shown on the input side and an SMS synthesis step shown on the output side correspond to the above-mentioned processes performed by the SMS analyzer 20 and the SMS sound synthesizer 110, respectively.

Figure 7:
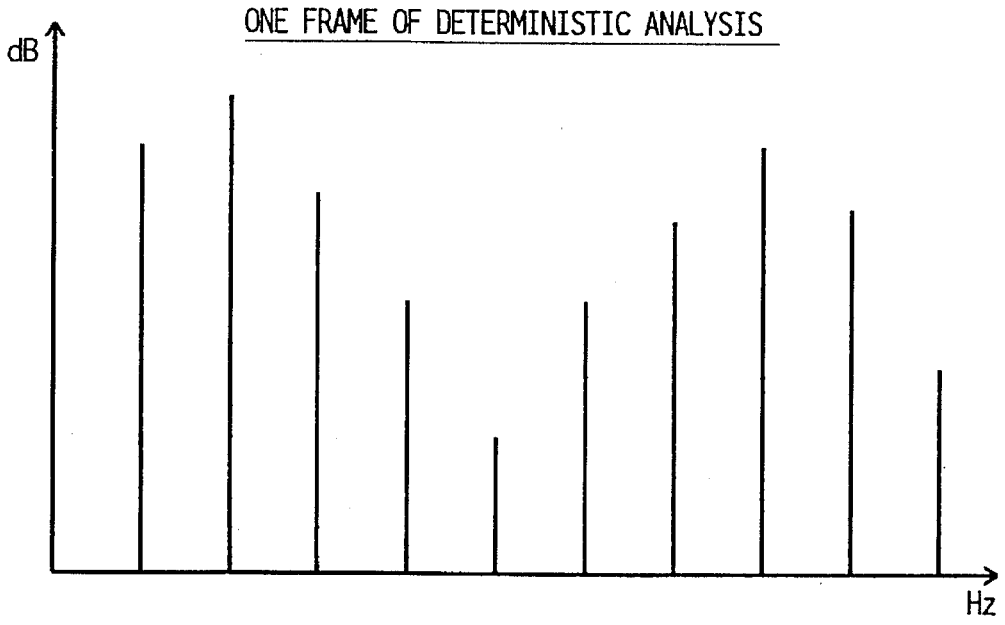
FIG. 7 is a line spectrum diagram, illustrating an example of deterministic component data, i.e., line spectral data for one frame, of SMS-analyzed data that are input to the format extraction/manipulation system shown in FIG. 6.
Figure 8:
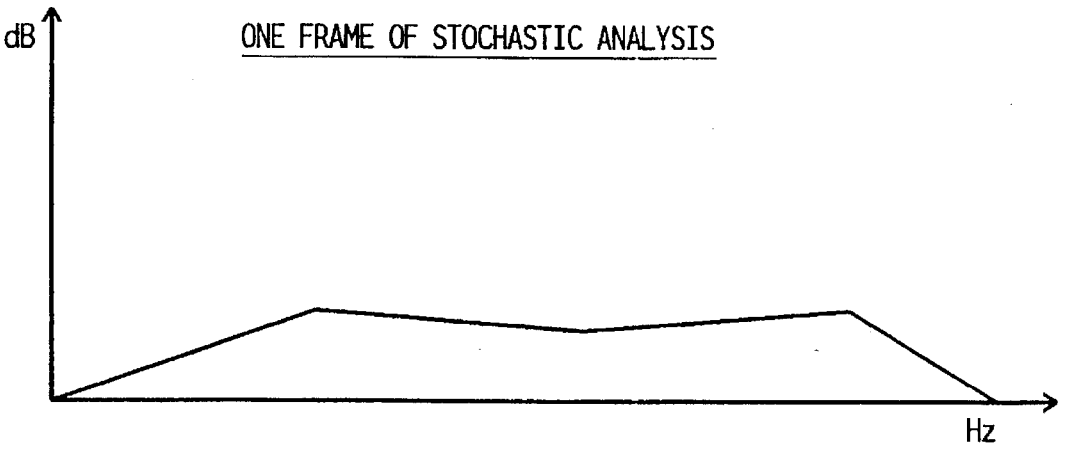
FIG. 8 is a diagram of a spectral envelope, illustrating a stochastic envelope for one frame, of the SMS-analyzed data that are input to the formant extraction/manipulation system shown in FIG. 6.

As previously mentioned, the SMS data obtained by the SMS analysis contain the frequency and magnitude trajectories and the stochastic envelopes (residual spectral envelopes). The processes according to this function are not applied to the stochastic envelopes, but they are applied to the analysis result of the deterministic portion, i.e., line spectral data, namely, frequency and magnitude trajectories. To facilitate understanding, there is shown in FIG. 7 an example of the analysis result of the deterministic portion, namely, line spectral data for one frame which exhibit characteristics of formant, and there is shown in FIG. 8 an example of the stochastic envelope for the corresponding frame.

Referring to FIG. 6, processes of steps 80 and 81 correspond to the process of step 36 in FIG. 3. In step 80, a process is performed to extract formants from the line spectral data of one frame. Namely, in this step, a process is performed such that a formant hill is detected from a set of line spectral data, and the detected formant hill is expressed in suitably represented parameter. The parameter representation corresponds to the above-mentioned formant data. Then, the formant extraction is done for each frame so as to obtain the parameter representation, namely, formant data for each frame. In this manner, there is obtained a series of formant data that are timewise variable for each frame (referred to as a formant trajectory). If a plurality of formants are present in one set of line spectra, there will be a successive formant trajectory for each formant. Here, an exponential fitting approach is proposed as a way to make parameter representation of the formant data.

Figure 9:
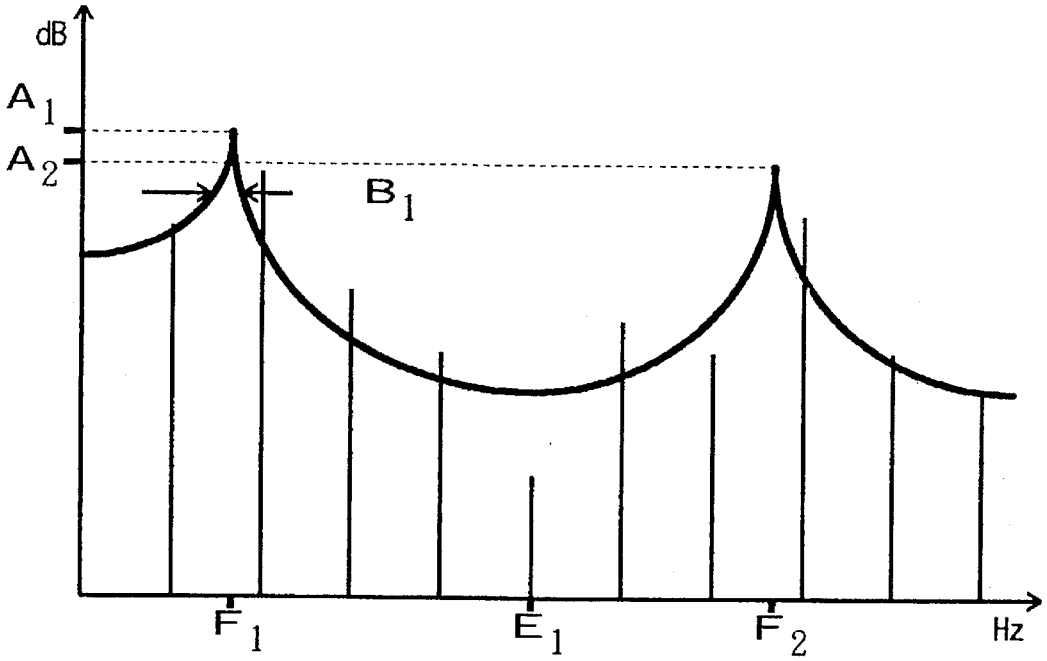
FIG. 9 is a diagram explanatory of a manner in which a formant in a given line spectrum is detected by an exponential function approximation in accordance with the embodiment shown in FIG. 6.

Normally, a formant can be described by a triangular function in the power spectrum or a two-sided exponential function in the dB spectrum. Since the dB spectrum is closer to human perception, it is more meaningful to work with this type of spectrum. So, both sides of the formant are approximated by exponential functions. Therefore, at each side of the formant, optimum exponential functions are found which match the slope of the formant, and the thus-found exponential functions are used to represent the formant. There may be considered a wide variety of ways to find the optimum exponential functions and to represent the formant in exponential functions. One example of such processes will be described below with reference to FIG. 9.

In this example, a formant is represented by the following four values. Here, ι is a frame number specifying a frame, and i is a formant number specifying a formant.

(1) center frequency Fi(ι): parameter indicative of the center frequency of ith formant, (2) peak level Ai(ι): parameter indicative of the amplitude value at the center frequency of the ith formant, (3) bandwidth Bi(ι): parameter indicative of the bandwidth of the ith formant, (4) intersection Ei(ι): parameter indicative of the intersection point between the ith formant and adjacent formant i+1.

The first three values are known standard values for formant representation, but the last-mentioned intersection parameter is new for this system and indicates, for example, one partial or a spectral frequency located at the intersection point between the formants i and i+ 1. However, the first three parameters are also obtained by a new approach using exponential fitting.

More fuller explanation on the process of step 80 is as follows.

(1) Several local maxima are found from among magnitude data an (ι) corresponding to the line spectra or partials for frame ι. Here, as in the expression 1 above. n is a variable whose value may change like n=0, 1, 2, . . . , N−1. N is the number of line spectra, i.e., partials analyzed at the frame.

(2) For each of the found local maxima, two local minima surrounding or neighboring the local maximum on both sides are found. One local maximum and two neighboring local minima thus found describe one formant hill.

(3) From each hill described by each local maximum and two neighboring local minima, each of the abovementioned mentioned parameters Fi, Ai, Bi, Ei is calculated. Thus, formant data Fi, Ai, Bi, Ei corresponding to each formant i for frame ι are obtained.

(4) Formant data corresponding to each formant i obtained for frame ι are assigned to individual formant trajectories. The formant trajectory to which each formant data should be assigned is determined by looking for the closest one in center frequency. This ensures the formant continuity. If there is no formant trajectory closest in center frequency with a predetermined tolerance in the previous formant trajectories, a new formant trajectory may assigned for the formant.

Description will now be made below on the algorithm for calculating the parameters Fi, Ai, Bi, Ei in the item (3) step above.

Once a hill has been identified by one local maxima and two neighboring local minima in the item (2) step above, it is necessary to find a two-sided exponential function that matches the hill.

This problem can be mathematically formulated by the following equation:

$$e = \sum_{n=Ll}^{n=Lr} \left[ x^{-|F-fn|} - \frac{an}{A} \right]^2 \quad \text{(Expression 2)}$$

for $n = Ll, \ldots Lr$ where F and A are unknown numbers indicative of the center frequency and peak-level amplitude value of the formant to be obtained. Ll and Lr are the orders of partials corresponding to the left and right local minima. fn and fa are the frequency and amplitude (namely magnitude) of partial i inside the hill, and x is the base of the exponential function used for approximation. −|F−fn| is the exponential part of the exponential function. Further, e is the error of the fit between the exponential function and the partials. That is, the foregoing two expressions are tolerance functions based on the least square approximation technique. Thus, F, A and x are found such that the tolerance e becomes the smallest value possible. That is a minimization problem that is very difficult to solve. But, since the fit for the present invention is not very critical, any other simpler approach may be employed. So, a simpler algorithm for finding A, F and x is proposed as follows.

The proposed simpler algorithm obtains the formant frequency (F) and the formant amplitude (A) by refining the local maxima. This is done by performing a parabolic interpolation on the three highest amplitude values of the hill. The position of the maximum obtained as the result of the interpolation corresponds to the formant frequency (F), and the height of the maximum corresponds to the formant amplitude (A).

The formant bandwidth B is traditionally defined as the bandwidth at −3 dB from the tip of the formant. Such a value describes the base of the exponential function. They are related by:

$$B = -2F \frac{\ln[(A-3)/A]}{\ln(x)} \quad \text{(Expression 3)}$$

The formant whose bandwidth best matches all partials is found. This is done by first finding the exponential function value xn for every partial n by the following equation:

$$xn = e^{\frac{\ln[an/A]}{|F-fn|}} \quad \text{(Expression 4)}$$

Then, the foregoing exponential function value xn for every partial n is substituted for x in the expression 3, so that a provisional bandwidth Bn for each xn is obtained, and the average provisional bandwidth Bn is taken by the following equation:

$$B = \frac{1}{Lr - Ll} \sum_{n=Ll}^{n=Lr} Bn \quad \text{(Expression 5)}$$

for $n = Ll, \ldots Lr$

This average bandwidth B is used as the formant bandwidth and describes the exponential function used as formant.

The intersection parameter Ei indicative of the ith and i+1th formants uses the frequency of the local minimum at the right end of the formant i.

Figure 10:
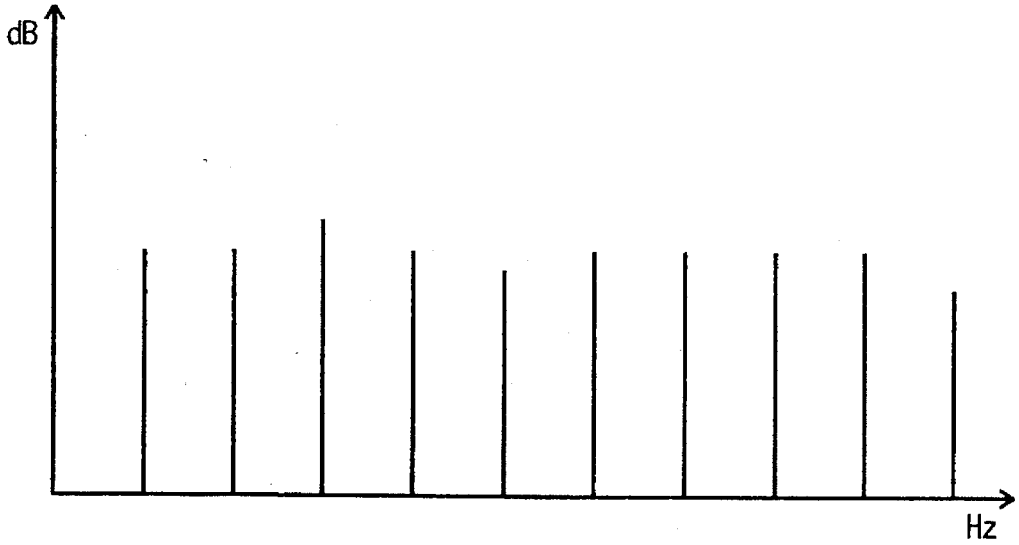
FIG. 10 is a diagram illustrating an example of a line spectrum structure flattened by removing the characteristics of the detected formant therefrom.

Referring back to FIG. 6, in step 81, the formant data of one frame extracted in the above-mentioned manner are used to subtract the formant structure from a set of partials for the frame. The formant structure can be considered to be relative values representative of the shape of the formant. Subtracting the formant structure from a set of partials or line spectra means subtracting variations produced by the formant to thereby flatten the set of partials, i.e., line spectra of the deterministic part. Therefore, the line spectra data of the deterministic part resultant from the process of step 81 will have a flattened spectral structure as shown, for example, in FIG. 10.

In an example of this method, functions describing all the partials of one frame are generated on the basis of all the formant data of the frame, and the amplitude values are normalized so that the functions have an average value of zero. The thus-normalized functions represent the formant structure. Then, for each individual partial of a set of the partials for that frame, the amplitude value of the normalized function corresponding to the frequency position is subtracted from the magnitude value. Of course, any other approach may be employed.

Process of step 82 corresponds to the processes of steps 52, 62 and 71 in FIG. 5. Namely, in this step, a process is performed for freely changing, in response to by the user controls, the formant data extracted in the foregoing manner.

Further, process of step 83 corresponds to the process of step 58 in FIG. 58. Namely, in this step, the formant data modified in the above-mentioned manner is added to the line spectral data of the deterministic component, in such a manner that formant characteristics are imparted to the line spectral data of the deterministic component.

According to this formant manipulation, the user can freely control the formant by controlling the four parameters F, A, B, E. Since these four parameters F, A, B, E directly correspond to the formant characteristics and shape, there can be achieved an advantage that the formant manipulation and control are facilitated to a considerable degree. Further, the above-proposed method for the formant analysis and extraction is advantageously much simpler than the conventionally-known least square approximation technique such as the LPC (Linear Predictive Coding), and required calculation for this method can be done in a very efficient manner.

Another Example of Formant Extraction and Manipulation

FIG. 11 is a general block diagram illustrating another example of the formant extraction and manipulation. Here, this example is the same as the one shown in FIG. 6 except that step 80a for formant extraction is different from step 80 of FIG. 6.

Figure 12:
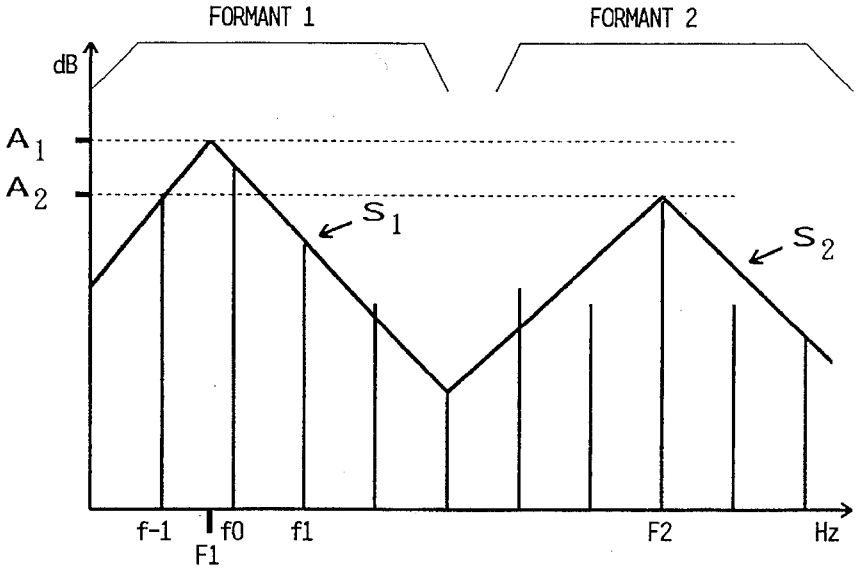
FIG. 12 is a diagram explanatory of a manner in which a format in a given line spectrum is detected by a triangular function approximation in accordance with the embodiment of FIG. 11.

In this system, a formant is approximated by an isosceles triangular function in the dB spectrum. Since the dB spectrum is closer to human perception, it is more useful to work with this type of spectrum. Therefore, in this system, a triangular function is found which matches the slope of the formant, and the found triangular function is used to represent the formant. There may be a wide variety of ways to find the optimum triangular function and to represent the formant, one of which way will be described below with reference to FIG. 12.

In this example, one formant is represented by the following three values. (ι) is a frame number specifying a frame, and i is a formant number specifying a formant.

(1) center frequency Fi(ι): parameter indicative of the center frequency of ith formant, (2) peak level Ai(ι): parameter indicative of the amplitude value at the center frequency of the ith formant, (3) slope Si(ι): parameter indicative of the slope (slope of a side of an isosceles triangle) of the ith formant.

The first two parameters are conventional standard formant representations, but the last-mentioned slope parameter replaces the traditional bandwidth and is quite new for this system. It is very easy to convert this slope into a bandwidth.

More fuller description on the process of step **80*a*** is as follows.

Figure 13:
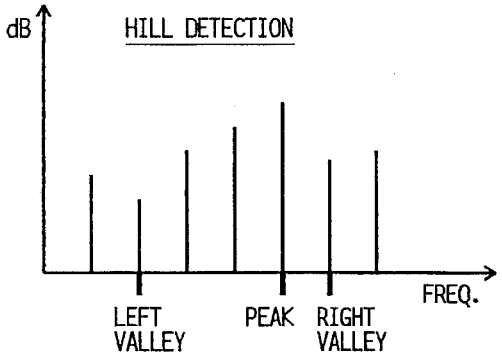
FIG. 13 is a diagram explanatory of a manner in which a formant hill is detected as a first step of the triangular function approximation of a formant.

(1) Hill Detection: Several local maxima, i.e., peaks are found from among the magnitude data an(ι) corresponding to line spectra or partials of frame ι. For each of the found local maxima, two local minima surrounding or neighboring the local maximum on both sides (i.e., valleys) are found. One local maximum and two neighboring local minima thus found describe one formant hill. One example of such hill is illustrated in FIG. 13.

(2) Triangle Fitting: From every hill described by each local maximum and two neighboring local minima, each of the above-mentioned parameters Fi, Ai, Si is calculated. Thus, formant data Fi, Ai, Si corresponding to each formant i for frame ι are obtained.

Figure 16:
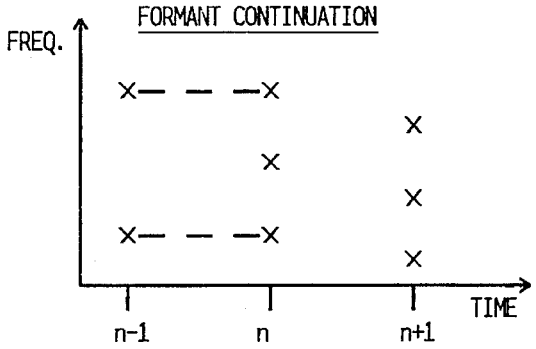
FIG. 16 is a schematic representation of a manner in which the detected formant is assigned to a trajectory.

(3) Formant data corresponding to each formant i obtained for frame ι are assigned to the respective formant trajectories. The formant trajectory to which each formant data should be assigned is determined by looking for the closest one in center frequency. This ensures the formant continuity. If there is no formant trajectory closest in center frequency with a predetermined tolerance in the previous formant trajectories, a new formant trajectory may be assigned for the formant. FIG. 16 is a schematic representation explanatory of the formant trajectory.

The hill detection step in the item (1) step above will be further described below.

If the magnitudes, i.e., amplitude values a–1, a0, a1 of neighboring three partials satisfy the following condition, then the partial corresponding to the central magnitude a0 may be detected as a local maximum:

$$a_{-1} \leqq a_0 \geqq a_1 \qquad \text{(Expression 6)}$$

Then, two neighboring valleys on both sides of the local maximum are detected as local minima.

Next, description will be made on the algorithm for computing the individual parameters Fi, Ai, Si in the item (2) step above.

The center frequency Fi is, as previously mentioned, obtained by performing a parabolic interpolation on the three highest amplitude values of the hill. As the algorithm for this purpose, the following expression may be used:

$$d = \frac{0.5(a_{-1} - a_1)}{a_{-1} - 2a_0 + a_1} \qquad \text{(Expression 7)}$$

$$\text{if } (d < 0) \quad Fi = f_0 + d(f_0 - f_{-1}) \qquad \text{(Expression 8)}$$

$$\text{if } (d \geqq 0) \quad Fi = f_0 + d(f_1 - f_0),$$

where f–1, fo, f1 are the frequency values of the three neighboring partials corresponding to the above-mentioned magnitudes a–1, a0, a1. d is the distance from the central frequency value f0 to the actual center frequency Fi. d is obtained by Expression 7, and then the thus-obtained d is applied to Expression 8 so as to obtain Fi.

Figure 14:
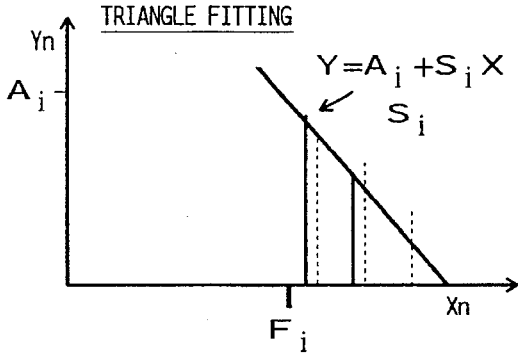
FIG. 14 is a schematic representation explanatory of a manner in which the line spectrum is folded back about the center frequency of the formant to achieve an isosceles triangle approximation, as a second step of the triangular function approximation.

Then, a data set is made in which each of the partials is substituted by a relative value (xn, yn) corresponding to the distance from the center frequency Fi. The value xn is a relative value of frequency and is obtained by:

$$xn = |Fi - fn| \qquad \text{(Expression 9)}$$

where fn is the frequency of each partial n. Since the absolute value of the difference is the relative value in Expression 9, all the partials xn are, as schematically shown in FIG. 14, are caused to move to one side of the center frequency Fi. yn is the amplitude of the partial x corresponding to each relative frequency xn, and it directly corresponds to the magnitude an of each partial n.

$$yn = an \qquad \text{(Expression 10)}$$

In this way, the triangular fitting problem can be converted into a simple line-fitting problem; that is, the parameters Ai and Si can be found using the following primary function y:

$$y = Ai + Si * x \qquad \text{(Expression 11)}$$

x and y in this Expression 11 are substituted by the above-mentioned data set (xn, yn), and Ai and Si are found in accordance with the following least square approximation technique such that the tolerance e becomes the smallest possible value:

$$e = \sum_{n=Ll}^{n=Lr} (y_n - A_i - S_i x_n)^2 \quad \text{(Expression 12)}$$

for $n = Ll, \ldots Lr$

L1 and Lr are the orders of the partials corresponding to the two local minima, i.e., valleys. The solution is obtained by the following expression:

$$A_i = \frac{DxxDy - DxDxy}{Dx^2 - Dxx} \quad \text{(Expression 13)}$$

$$S_i = \frac{Dxy - DxDy}{Dx^2 - Dxx}$$

where derivatives Dx, Dy, Dxx, Dxy are as follows:

$$Dx = \sum_{n=Ll}^{n=Lr} x_n, \quad Dy = \sum_{n=Ll}^{n=Lr} y_n \quad \text{(Expression 14)}$$

$$Dxx = \sum_{n=Ll}^{n=Lr} x_n^2, \quad Dxy = \sum_{n=Ll}^{n=Lr} x_n y_n$$

The resulting slope Si corresponds to the right slope of the triangle. The left slope of the triangle will be −Si. The offset value Ai corresponds to the peak level of the formant.

Figure 15:
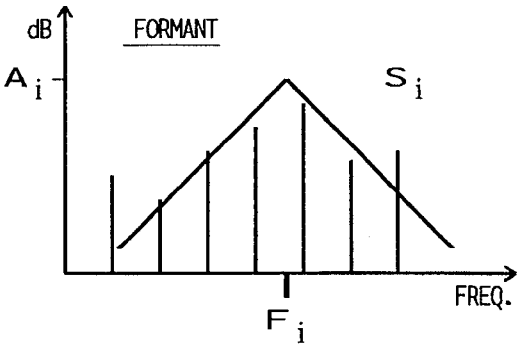
FIG. 15 is a schematic representation of a state in which the isosceles triangle approximation has been achieved as a third step of the triangular function approximation.

The foregoing procedures make it possible to obtain the three parameters Fi, Ai, Si defining an isosceles triangle approximation which best matches the formant. In FIG. 15, there is shown such an isosceles triangle approximation of the formant.

As previously mentioned, the formant bandwidth Bi is traditionally defined as the bandwidth at −3dB from the tip of the formant, and therefore it can be readily calculated on the basis of the formant center frequency Fi and slope Si, by the following expression:

$$Bi = 2\left(\frac{-3}{Si} + Fi\right) \quad \text{(Expression 15)}$$

The slope parameter Si may be directly given the formant modification step 83, may be given to step 83 after having been converted into the bandwidth parameter. In an alternative arrangement, the triangle approximation of formant may be done by separately approximating the slope of each side in accordance with other scalene triangle approximation than the foregoing isosceles triangular approximation.

According to this formant manipulation, the user can freely control the formant by controlling the three parameters F, A, S. Since these three parameters F, A, S directly correspond to the characteristics and shape of the formant, there can be achieved an advantage that the formant manipulation and control is facilitated to a considerable degree. Further, the above-proposed formant analysis and extraction method is advantageously much simpler than the conventionally-known least square approximation technique such as the LPC, and required calculation for this method can be done in a very efficient manner. Moreover, because the formant analysis and extraction are performed on the basis of the isosceles approximation, it suffices to calculate only one slope, making the required algorithm even simpler.

Vibrato Analysis and Manipulation

A vibrato is detected by analyzing, for each partial, the time function of the frequency trajectory.

Figure 17:
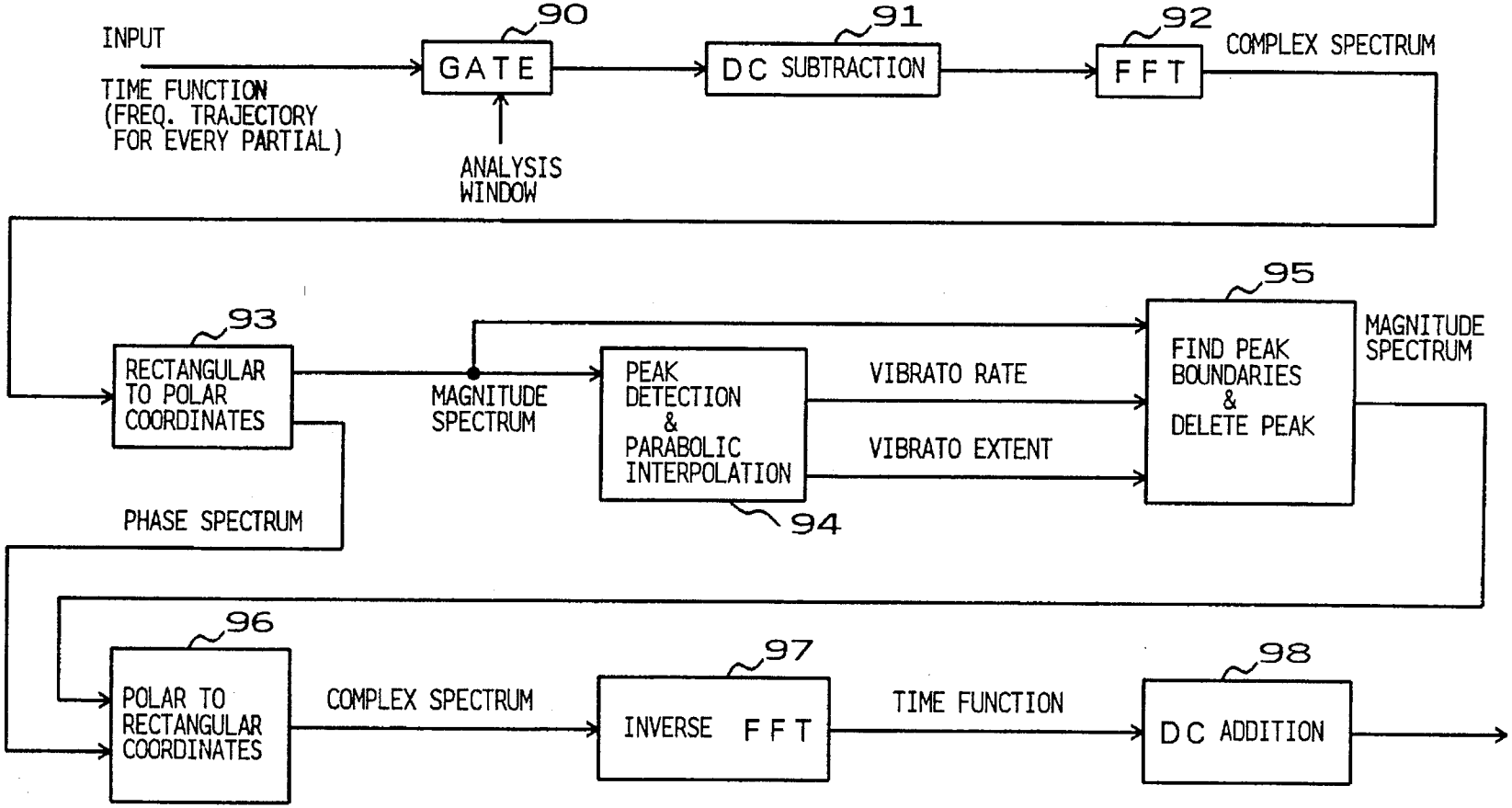
FIG. 17 is a block diagram of an embodiment of a vibrato analysis system in accordance with the present invention.

FIG. 17 is a general block diagram illustrating an example of a vibrato analysis system, which corresponds to the process of step 37 in FIG. 3. Because the vibrato analysis is performed for each partial, the input to this analysis system is the frequency trajectory of a certain partial and is a time function representative of the frequency for each frame. As may be readily understood, if the time function of the frequency time-varies at such a cycle that can be regarded as a vibrato, then the time-varying component can be detected as a vibrato. Accordingly, the vibrato detection can be achieved by detecting a lower-frequency time-varying component in the frequency trajectory. To this end, in the arrangement of FIG. 17, the vibrato detection is performed using the fast Fourier transformation technique.

First, in step 90, the time function of a certain frequency trajectory to be analyzed is input to the system and gated by predetermined time window signals for the vibrato analysis. The time window signals gate the time function of the frequency trajectory in such a manner that adjacent frames are overlapped in frame size at a predetermined ratio (for example, ratio of 3/4). The term "frame" as used here is different from the frame in the above-mentioned SMS data and corresponds to a time longer than the latter. If, for example, one frame established by the time window signals has a duration of 0.4 second and the overlap ratio is 3/4, a time difference of 0.1 second will be present between adjacent frames. This means that the vibrato analysis is performed at an interval of 0.1 second.

The gated signal is then applied to a direct current subtracter 91, where DC component is removed from the signal. This can be done by, for example, calculating the average of function values within the frame, and removing the calculated average as DC component, namely, subtracting the average from the individual function values. Then, the resulting signal is applied to a fast Fourier transformer (FFT) 92, where the signal undergoes a spectrum analysis. In this way, the time function of the frequency trajectory is divided by the time window signals into a plurality of frames, and an FFT analysis is performed on the AC component for each frame. Since the analyzed output from the FFT 92 is in complex spectra, a rectangular-to-polar-coordinate converter 93 converts the complex spectra into magnitude and phase spectra. The magnitude spectra thus obtained are given to a peak detection and interpolation section 94.

Figure 18:
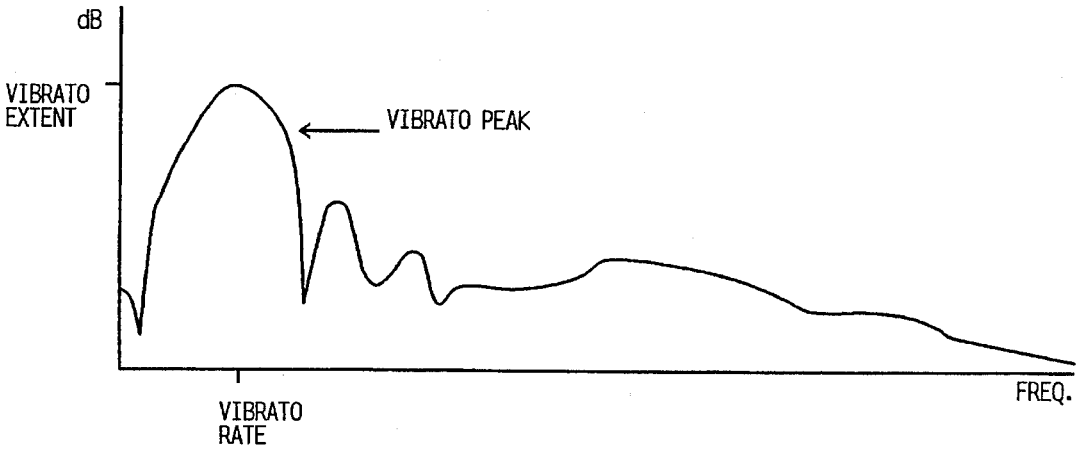
FIG. 18 illustrates an example of a spectral envelope obtained by Fourier-transforming a time function of a frequency trajectory in the embodiment of FIG. 17.

FIG. 18 shows an example of the magnitude spectrum in terms of its envelope. If a vibrato is present in the original sound, then there will be occurred such a peak as shown in a predetermined possible vibrato range of, for example, 4–12 Hz. So, detection is made of the peak in this vibrato range, and the frequency location of the detected peak is then detected as a vibrato rate. The process for this purpose is performed in peak detection and interpolation step 94. An example of the process in this peak detection and interpolation step 94 is as follows.

Figure 20:
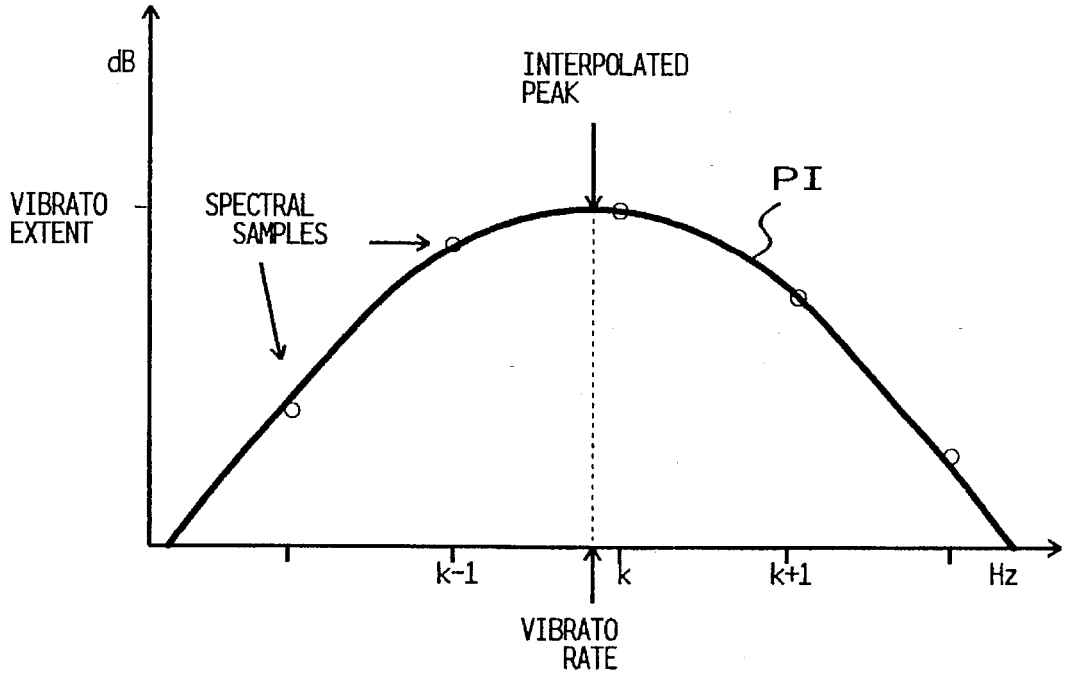
FIG. 20 illustrates a manner in which, in the embodiment of FIG. 17, a vibrato rate is calculated from the spectral characteristics as shown in FIG. 18 by a parabolic approximation.

(1) First, of a given magnitude spectrum, detection is made of a maximum amplitude value, i.e., local maximum in the predetermined possible vibrato range. FIG. 20 shows, in a magnified scale, the predetermined possible vibrato range, in which k corresponds to the spectrum of the local maximum, and k−1 and k+1 correspond to the spectra on both sides of the local maximum spectrum.

(2) Then, a parabola passing the local maximum and amplitude values of the neighboring spectra is interpolated. Curve P1 in FIG. 20 denotes a parabola resulting from this interpolation.

(3) Next, a maximum value in the parabolic curve P1 obtained by the interpolation is identified. Then, the frequency location corresponding to the maximum value is detected as the vibrato rate, and at the same time the interpolated maximum value is detected as the vibrate extent. The vibrato data extracted as musical parameters comprise these vibrato rate and vibrato extent. It will be readily appreciated that, because extraction of the vibrato data is done for every frame, reliable extraction of the time-varying vibrato data is guaranteed.

Figure 19:
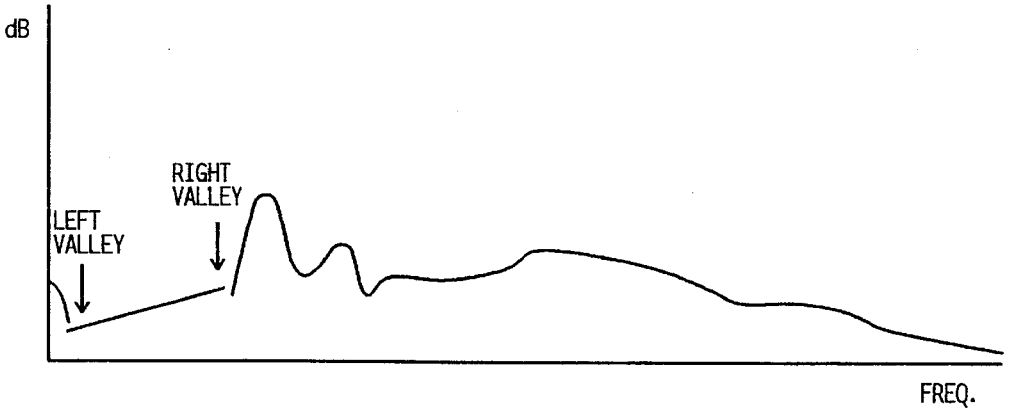
FIG. 19 is a diagram of an example spectral envelope illustrating a state in which a vibrato component has been removed from the spectrum of FIG. 18.

Referring back to FIG. 17, in step 95, the vibrato component detected in step 95 is subtracted from the magnitude spectrum obtained by the rectangular-to-polar-coordinate converter 93. In this case, two valleys on both sides of the detected vibrato hill are found, and as shown in FIG. 19, a linear interpolation is made between the two valleys to remove the hill of the vibrato component. FIG. 19 is a schematic representation of an example of the magnitude spectrum as processed in step 95.

Next, the magnitude spectral data from which the vibrato component has been removed and the phase spectral data obtained by the rectangular-to-polar-coordinate converter 93 are input to a polar-to-rectangular-coordinate converter 96, where these data are converted into complex spectral data. After that, the complex spectral data is input to an inverse FFT 97 to generate a time function. The generated time function is then given to a DC adder 98, where the DC component removed in the DC subtracter 91 is added back to the time function, so as to generate a time function of the frequency trajectory for one frame from which the vibrato component has been removed. Thus, the vibrato-component-free frequency trajectories for plural frames are connected with each other, so as to produce a successive frequency trajectory corresponding to the partial in question. It is assumed that, in the connected trajectory, the data are connected in an overlapped fashion by the overlapped frame time. The way to connect the overlapped data portions may be average value or other suitable interpolation. Alternatively, in the overlapped data portions, the data of only one frame may be selected, with the data of the other frame being discarded. Such a process for the overlapped data portion can also be performed on the detected vibrato rate and vibrato extent data as the case may be.

Figure 21:
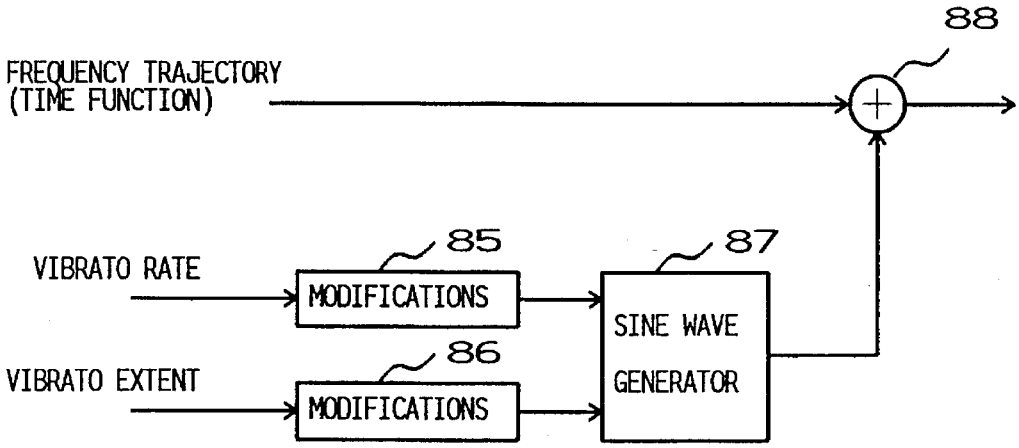
FIG. 21 is a block diagram of an embodiment of a vibrato synthesis algorithm in accordance with the present invention.

FIG. 21 is a general block diagram illustrating an example vibrato synthesis algorithm. Processes of steps 85, 86 correspond to the processes of steps 52, 62, 69. That is, in these steps, processes are performed such that the data of the vibrato rate and vibrato extent extracted in the foregoing manner are freely modified in response to the user controls. Processes of steps 87, 88 correspond to the process of step 57 in FIG. 5. In step 87, on the basis of the data of the vibrato rate and vibrato extent modified as mentioned above, a vibrato signal is generated in, for example, sinusoidal wave function. In step 88, by the use of the sinusoidal wave function corresponding to the vibrato rate and vibrato extent, an arithmetic operation is performed for modulating the frequency value in the corresponding frequency trajectory in the SMS data. Thus, a vibrato-imparted frequency trajectory is obtained.

In the foregoing example, for each partial, the vibrato data is extracted to be controlled or modified and then the vibrato synthesis is performed. However, since the vibrato rate need not be different for each partial, the vibrato data extracted from the fundamental wave component, or the average value of the vibrato data extracted from the several lower-order partials may be shared among all the partials. Similarly, as for the vibrato extent, a predetermined one may be shared among all the partials.

Tremolo Extraction and Manipulation

A tremolo is detected by analyzing the time function of the magnitude trajectory for each partial. A tremolo can be said to be a kind of amplitude vibrato, and therefore the same algorithm for the above-mentioned vibrato analysis and synthesis can be used for this operation. The only difference between a tremolo and a vibrato is that as for a tremolo, analysis and synthesis are performed on the magnitude trajectory in the SMS data. That is, the analysis and synthesis of a tremolo can be done by applying to the magnitude trajectory an analysis/synthesis algorithm that is similar to that described in connection with FIGS. 17 to 21. Accordingly, by reading the "frequency trajectory" in FIGS. 17 to 21 as "magnitude trajectory", an embodiment of the tremolo analysis and synthesis may be self-explanatory. As tremolo data, parameters comprising a tremolo rate and a tremolo extent will be obtained.

Similarly, as for the stochastic component, periodic variations of the amplitude similar to those for a tremolo can be analyzed to be controlled or modified and then synthesized. Among the residual spectral envelope data corresponding to the stochastic component in the SMS data, there is data indicative of the overall gain of the spectral envelope data, which will be referred to as a stochastic gain. Further, a series of the stochastic gains for the sequential frames will be referred to as a stochastic gain trajectory. The stochastic gain trajectory is a time function of the stochastic gain. Accordingly, the time function of the stochastic gain can be analyzed by an algorithm similar to that for a vibrato or a tremolo, and the analysis result can be used for control and synthesis purposes. Alternatively, the analysis stage may be omitted, in which case the tremolo data obtained from the analysis of the magnitude trajectory of the deterministic component may be used for the control and synthesis of the stochastic gain.

It is to be noted that the above-mentioned approach for the analysis, control and synthesis of a vibrato or a tremolo is applicable to other additive tone synthesis techniques than the SMS synthesis technique.

Spectral Tilt Control in Musical Sounds

Figure 22:
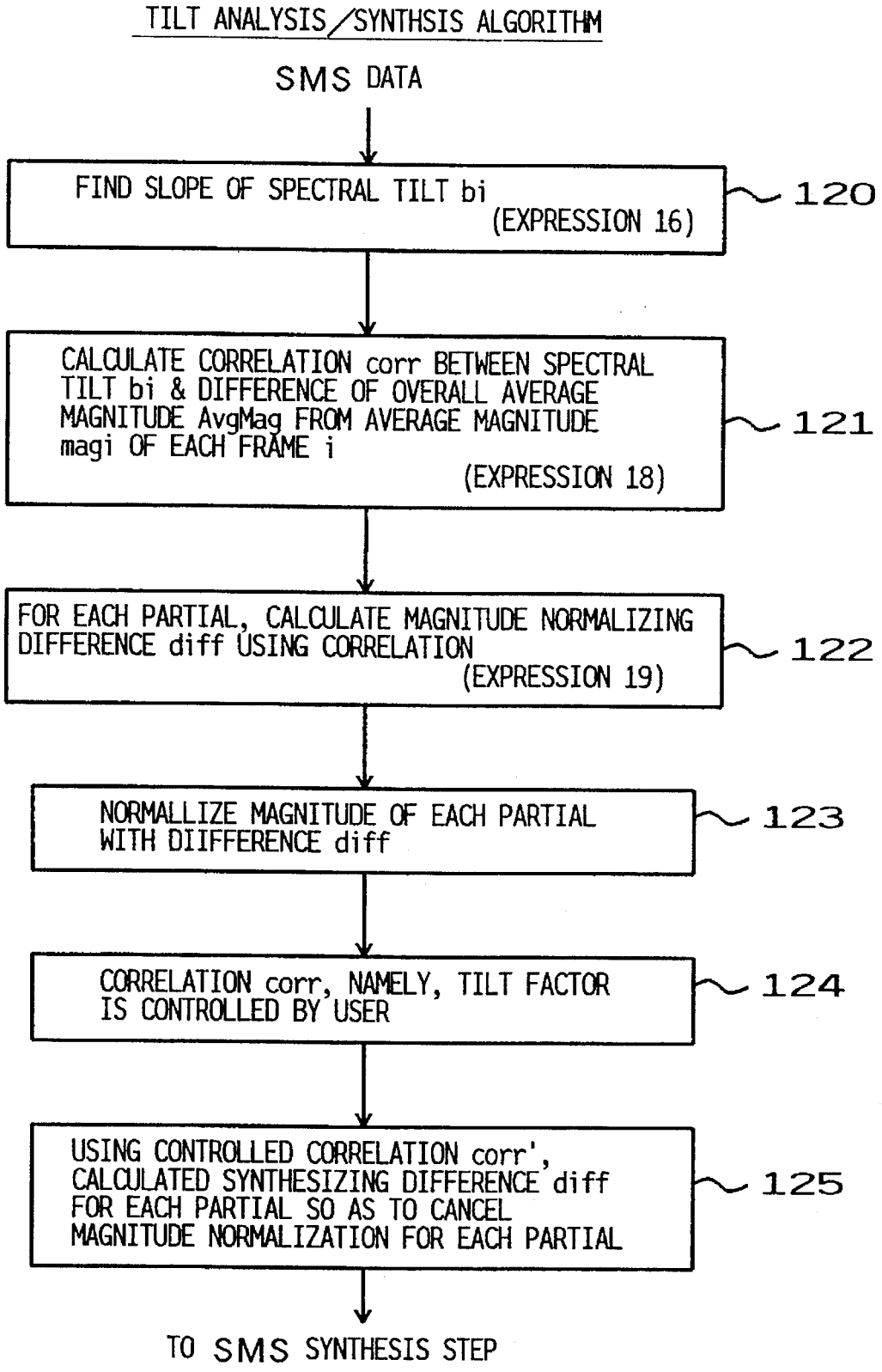
FIG. 22 is a block diagram of an embodiment of spectral tilt analysis/synthesis algorithms in accordance with the present invention.

FIG. 22 illustrates an analysis/synthesis algorithm for the spectral tilt control in accordance with this embodiment. Steps 120 to 123 correspond to the analysis algorithm and are performed in the SMS data processor 30 (FIG. 2). Steps 124 and 125 correspond to the synthesis algorithm and are performed in the reproduction processor 50 (FIG. 4).

Figure 23:
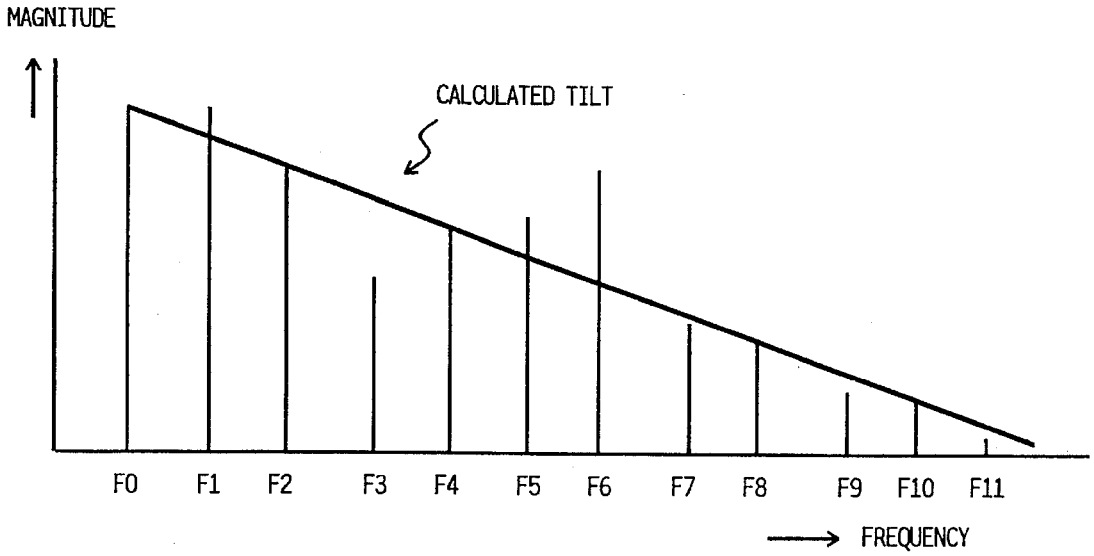
FIG. 23 illustrates an example of a spectral tilt obtained by analyzing, in accordance with the embodiment of FIG. 22, deterministic component data, i.e., line spectra of one frame of SMS analysis data.

Spectral Tilt Analysis:

First, description will be made on the spectral tilt analysis which is performed on the deterministic component. FIG. 23 shows an example of a line spectrum of the deterministic component and of a spectral tilt line comprising a linear slope which is obtained by analyzing the line spectrum. The analyzed spectral tilt line is shown in a solid line. The origin of the spectral tilt line is defined as the magnitude level value of the first partial that has the lowest frequency in the line spectrum of the deterministic component. Then, the slope is calculated by the optimum tilt line that generally approximates the magnitude value of all the other partials (step 120). This is a line-fitting problem, and therefore the spectral tilt slope b is calculated by the following expression:

$$b = \frac{\sum_{i=1}^{i=N-1} (x_i/x_0) * (y_i - y_0)}{\sum_{i=1}^{i=N-1} (x_i/x_0)^2} \qquad \text{(Expression 16)}$$

where i is the partial number, N is the total number of partials, x is the frequency of each partial, and y is the magnitude of each partial. The average magnitude mag for a particular SMS time frame can be calculated by $$mag = \frac{1}{N} \sum_{i=0}^{i=N-1} y_i \qquad \text{(Expression 17)}$$

From these calculations, it is possible to obtain a pair of the spectral tilt (b) and the average magnitude mag for each SMS time frame.

After that, calculation is made to obtain the average of the average magnitudes mag of the individual frames, i.e., the overall average magnitude AveMag. Then, the correlation between these two values is obtained in step 121 by $$corr = \frac{\sum_{i=1}^{i=M} b_i * (mag_i - AvgMag)}{\sum_{i=1}^{i=M} b_i^2} \quad \text{(Expression 18)}$$

where i is the SMS time frame number, and M is the total number of the SMS time frames. The resulting correlation data corr indicates the correlation between the difference of the average magnitude magi for each frame i from the overall average magnitude AveMag (mag–AvgMag), as well as the spectral tilt bi for each frame i. In other words, the correlation data corr is representative of the spectral tilt data b for each frame which is normalized as such data correlative to the difference of the average magnitude magi for the corresponding frame i from the overall average magnitude AvgMag (mag–AvgMag). As may be readily understood from Expression 18, if the spectral tilts bi for all the frames i are equal, the sum of the differences of the individual samples magi from the overall average magnitude AvgMag (magi–AvgMag) will converge into zero, and therefore the correlation data will be zero. Because of this, it can be understood that the correlation data corr is a reference value or a normalizing value which represents the correlation of the spectral tilt bi of each frame, using, as a parameter, the difference of the overall average magnitude AvgMag from the frame-by-frame average magnitude magi.

The correlation data corr obtained in the foregoing manner is only one musical parameter concerning the spectral tilt, namely, a tilt factor. By modifying or controlling this tilt factor, namely, correlation data, the user can freely control the brightness or other expressional characteristics of a sound to be synthesized.

It should be understood that in the spectral tilt analysis, all the partials of the deterministic component need not be taken into consideration, and some of them may be omitted. For example, to define partials that should be considered in the foregoing Expression 16, a certain threshold may be established such that only the partials of a magnitude above this threshold are considered in the analysis. An alternative arrangement may be that the partials of a frequency above a predetermined frequency (for example, 8,000 Hz) are not considered in the analysis expression 16 so as to discard unwanted unstable elements for a proper spectral tilt analysis. Of course, it is also possible to make a comparison between the slope obtained from the analysis and the actual magnitude of each partial, in such a manner that the partials too remote from the slope are excluded and the analysis is performed once again.

Normalization by Spectral Tilt:

Next, using the spectral tilt analysis data obtained in the foregoing manner, a process is performed for normalizing the magnitude values of the deterministic component in the SMS data. In this process, the magnitude values of the individual partials are normalized with respect to the overall average magnitude AvgMag in such a manner that the line spectra of the deterministic component for every frame have an apparently common spectral tilt. To this end, a difference value diff for each partial is calculated by the following expression:

$$diff = corr*(AvgMag - mag)*(xi/x0) \quad \text{(Expression 19)}$$

where mag is the average magnitude of the SMS time frame in question, x0 is the frequency of the first partial of the time frame, and xi is the frequency of the partial about which this calculation is being made.

After that, the above-mentioned difference value diff calculated for each partial is added to the magnitude value of the corresponding partial to thereby obtain a normalized magnitude value (step 123).

Spectral Tilt Synthesis:

As previously mentioned, the user can freely modify or control the tilt factor, i.e., correlation data corr obtained from the spectral tilt analysis (step 124). In synthesizing a sound, a process is performed for controlling the magnitude value of each partial by the tilt factor. To this end, a difference value diff for synthesis is calculated for each partial in accordance with:

$$diff = corr'*(newmag - AvgMag)*(xi/x0) \quad \text{(Expression 20)}$$

where corr' is the tilt factor, i.e., correlation data having been modified or controlled by the user, newmag is the average magnitude of the frame that might have been suitably processed during the synthesis, x0 is the frequency of the first partial of the frame, and xi is the frequency of the partial i about which this calculation is being made. Thus, the difference value diff taking the tilt factor corr' into consideration is obtained for each partial. By adding the synthesizing difference value diff to the magnitude value of the corresponding partial, line spectral data is obtained which has been controlled by the spectral tilt modified as desired (step 125). Subsequently, on the basis of the SMS data including the modified line spectral data, a sound is synthesized in the SMS sound synthesizer 110 (FIG. 4). Accordingly, a sound is synthesized which have been freely controlled in its brightness and other expressional characteristics in accordance with the user's modification of the tilt factor, i.e., correlation data corr.

As may be readily understood, it will be possible to omit the laborious calculations such as the calculation of the correlation data corr if simplified controls where the spectral tilt does not vary with time are employed. Namely, the spectral tilt data obtained from the analysis may be freely controlled directly by the user, and the line spectral tilt may be controlled during the sound synthesis on the basis of the controlled spectral tilt data. Since the essence of the present invention is to control a synthesized sound by extracting and then controlling the spectral tilt, it should be understood that such simplified tilt analysis and synthesis fall within the scope of the present invention.

Like the above-mentioned other controls, the above-mentioned spectral tilt control is applicable not only to the SMS technique but also to other partial additive synthesis techniques.

Time Modifications of Sounds

The object of this time modification technique is to perform a control to lengthen or shorten the duration of a sound as represented by the SMS technique. The lengthening of the sound duration is achieved by cutting out a portion of the sound and repeatedly splicing it as is known from the looping technique for samplers. On the other hand, the shortening of the sound duration is achieved by deleting a properly chosen segment of the sound. In the example described below, the main characteristic feature is that the boundaries of the vibrato cycles are found in order to establish loop points.

Figure 24:
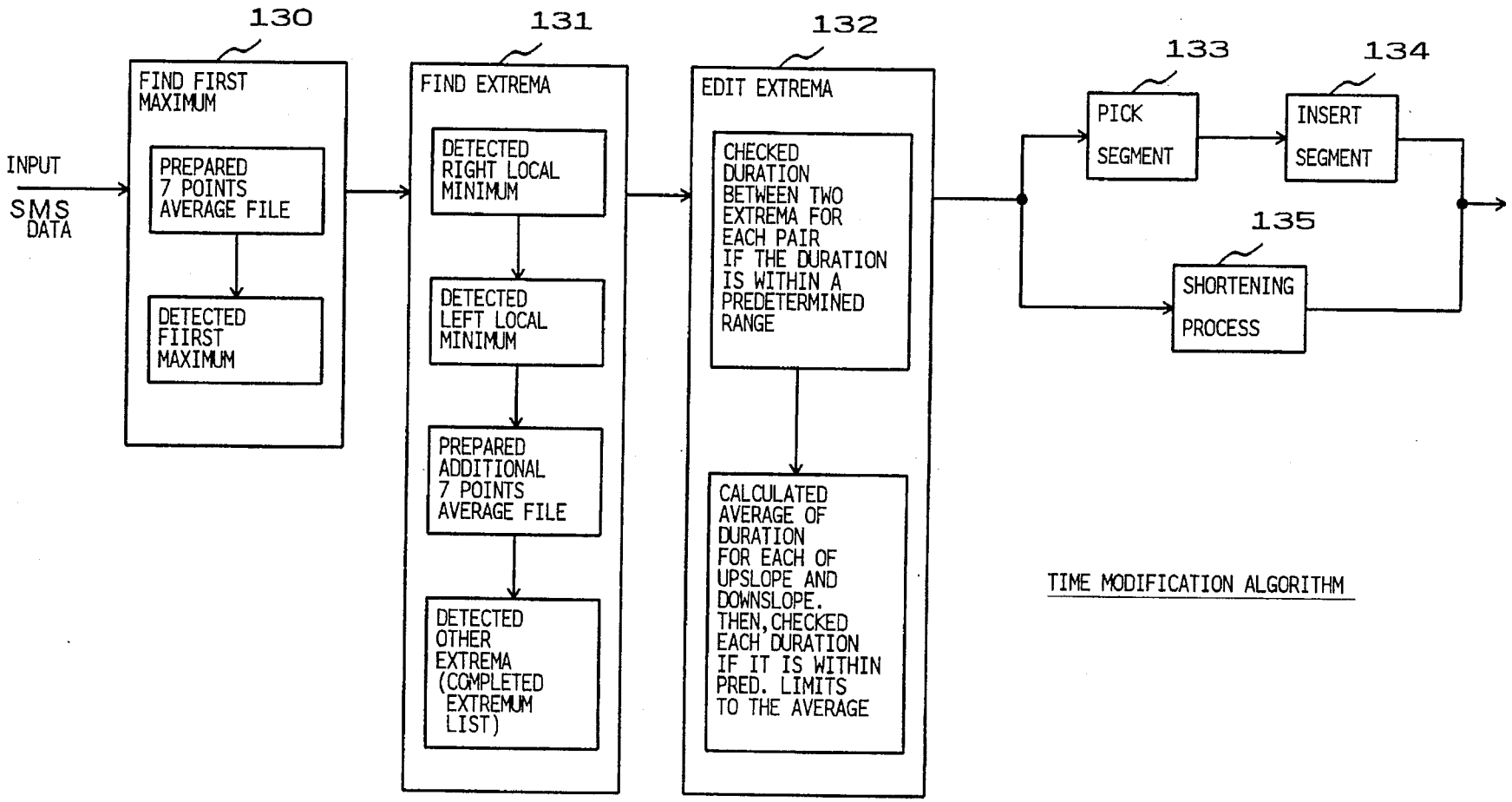
FIG. 24 is a block diagram of an embodiment of a sound duration modification algorithm in accordance with the present invention.

FIG. 24 shows an analysis/synthesis algorithm for the time modifications in accordance with this embodiment. Steps 130, 131, 132 correspond to the analysis algorithm and are performed in the SMS data processor 30 (FIG. 2). Steps 133, 134, 135 correspond to the synthesis algorithm and are performed in the reproduction processor 50 (FIG. 4).

According to the analysis algorithm executed in steps 130, 131, 132, detection is made of the boundaries of the vibrato cycles of the original sound. To this end, an analysis is performed on several frequency trajectories of lower-order partials where the vibrato characteristic is more likely to appear. In this example, the analysis is performed on two frequency trajectories of the first partial, i.e., fundamental wave and of the second partial, i.e., first harmonic.

First, in step 130, the algorithm begins looking in the center of the note to be analyzed, and the local maximum with the highest frequency is found from the frequency trajectories of the fundamental and first harmonic. This is determined as the first local maximum. More specifically, within a predetermined time range around the center of the note to be analyzed, frequency averages for seven frames are sequentially prepared for each of the frequency trajectories of the fundamental and first harmonic, and their files are prepared (preparation of 7 point averages). Thus, by comparing the frequency averages for the 7 frames, detection is made of the highest local maximum that occurs in both the fundamental and the first harmonic. Then, the location and value of the detected local maximum are listed as the first local maximum (detection of the first local maximum). Even if there is no vibrato in the original sound, detection of such a local maximum is possible. If the SMS time frame rate is 100 Hz, then the duration of the 7 points, namely, 7 frames will be 0.07 second.

Then, in step 131, a further search is made from the first local maximum detected in the above-mentioned manner, to find two local minima that have the lowest frequencies on both sides of the local maximum. The two local minima thus found are added to the list of the first local maximum. Then, a still further search is made in the time proceeding direction so as to find several pairs of local maximum and local minima until the end of the sound is reached. The found pairs are added to the list sequentially in the chronological order. In this manner, the values and locations of all the found local maxima and local minima, namely, extrema are stored into the list (extremum list) sequentially in the chronological order.

In more specific terms, a search is first made in the 7 point average file in the time proceeding direction from the first local maximum, in order to find the local minimum (right local minimum) having the lowest frequency that occurs in both of the fundamental and first harmonic. At this time, if necessary, the analysis target range is extended or stretched in the time progressing direction, and additional 7 point average data of each trajectory is prepared and added to the 7 point average file. Thus, the location and value of the found right local minimum are additionally stored into the extremum list adjacent to the right of the first local maximum (detection of the right local minimum).

Next, a further search is made in the 7 point average file of each trajectory backwardly, i.e., in the counter time progressing direction from the location of the first local maximum, in order to find the local minimum (left local minimum) having the lowest frequency that occurs in both of the fundamental and first harmonic. Also at this time, if necessary, the analysis target range is extended in the counter time progressing direction, and additional 7 point average data of each trajectory is prepared to be added to the 7 point average file. Thus, the location and value of the thus-found left local minimum are additionally stored into the extremum list adjacent to the left of the first local maximum (detection of the left local minimum).

Then, the analysis target range is extended in the time progressing direction to the near-end portion of the sound, additional 7 point average data of each trajectory is prepared to be added to the 7 point average file. After that, in a similar manner to the above-mentioned, a search is made in the 7 point average file of each trajectory in the time progressing direction so that frequency extrema (local maximum or local minimum) occurring in both of the fundamental and first harmonic are sequentially detected, and the location and value of each of the detected extremum is stored into the extremum list in the chronological order.

It is assumed that some of these extrema are the peaks and valleys of a vibrato cycle. The extremum location data is data corresponding to time.

In next step 132, the extremum data listed in the above-mentioned step 131 are studied, and an edit process is carried out such that only the extremum data assumed as the peak and valley of the vibrato cycle are kept while the other data than these are eliminated.

Specifically, the process is carried out as follows. First, it is examined whether or not the vibrato cycle found in the listed extremum data is within a predetermined vibrato rate range. That is, it is examined, for every pair of the maximum and minimum, whether or not the time difference between certain maximum and minimum in the extremum list falls in a predetermined time range. Typically, the time range may be between maximum 0.15 sec. and minimum 0.05 sec. In this manner, it is possible to find some pairs of the maximum and minimum outside the predetermined time range. This means that at least one of the maximum and minimum of each such pair is not a vibrato maximum or a vibrato minimum. As the result of the examination, each extremum pair having the time difference within the predetermined time range is marked to be kept. By the way, the predetermined time range defined with the above-mentioned values is rather broad, so that no valid vibrato extrema are unmarked. However, this broad time range will probably mark more extrema than those actually representing the vibrato. All extrema which are not marked here are henceforth ignored.

Figure 25:
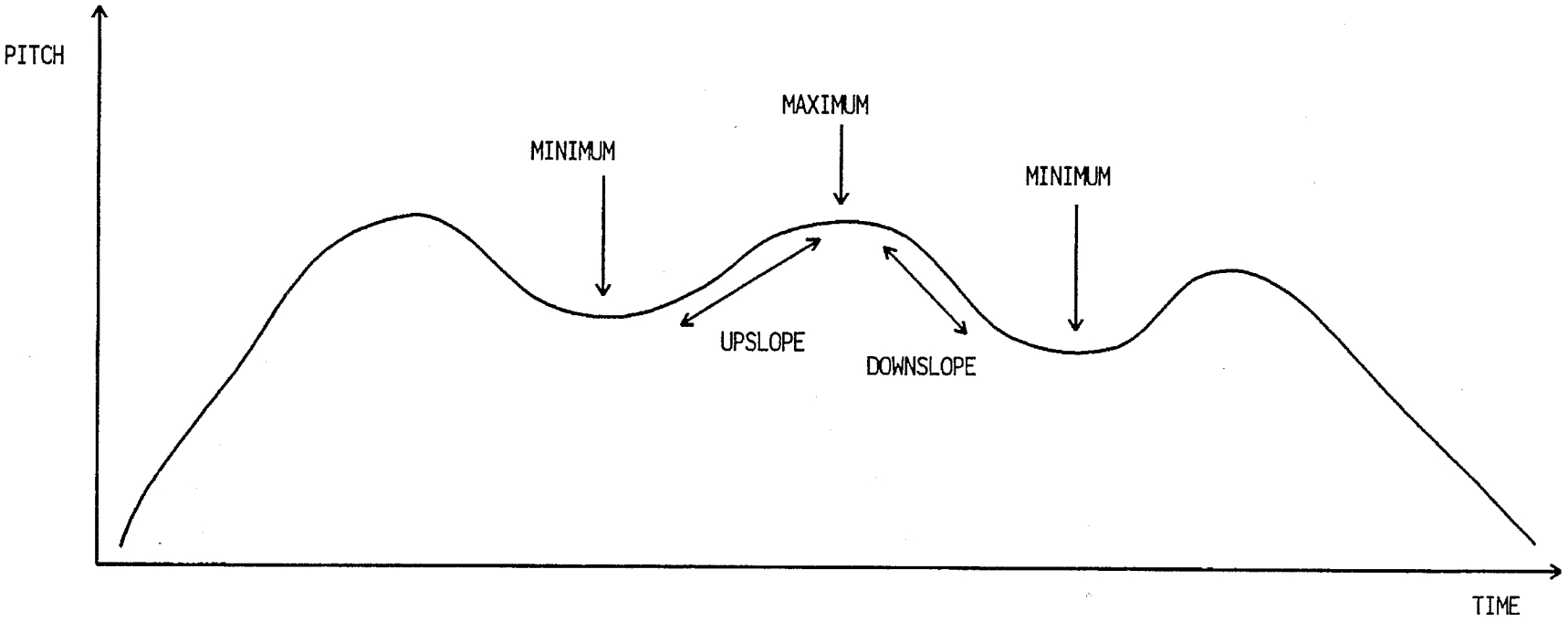
FIG. 25 illustrates an example of a vibrato extremum and a slope analyzed in accordance with the embodiment of FIG. 24.

Subsequently, for each extremum pair kept in the list, calculations are made to obtain the time interval of the minimum-to-maximum upslope and of the time interval of the maximum-to-minimum downslope (see FIG. 25). Then, the average of the individual upslope time intervals and the average of the individual downslope time intervals are calculated. After that, the relation between the upslope time interval for each extremum pair and the above-mentioned upslope average, the relation between the downslope time interval for each extremum pair and the downslope average are respectively examined in an attempt to see whether or not each of the time intervals is within a predetermined error limit from the corresponding average. The error limit may, for example, be 20% of the average. Each extremum pair falling within the error limit is marked to be kept. Note that each extremum except the first and last extrema is checked twice in total, for the upslope and downslope examinations. If either examination is true, then the extremum is marked to be kept.

As the result of the above-mentioned process, the extremum having been kept in the extremum list can be assumed as vibrate maximum and minimum. It is assumed that the segment used as a splicing waveform for the looping purpose is a waveform between two maxima or two minima. So, at least three extrema must be listed in the list. If there are only two or less extrema left on the list, the extremum edit process of this step 132 may be performed again as an error, in which case the reference value for each examination may be relaxed.

In synthesizing a sound, controls are made such that the sound duration time is lengthened by the use of the extremum list having been edited in the foregoing manner.

According to the synthesis algorithm represented by steps 133, 134, 135 of FIG. 24, a duration lengthening sub-algorithm is performed in steps 133, 134 for lengthening the sound duration time, and a duration shortening sub-algorithm is performed in step 135 for shortening the sound duration time.

The lengthening sub-algorithm will be described first below.

In step 133, with reference to the extremum list, waveform data corresponding to the segment used as the splicing waveform for the looping purpose are retrieved from a waveform memory. The segment comprises waveform data between two maxima or two minima. Because the extremum list has been prepared, it can be completely freely selected from which portion of the recorded original sound the looping segment waveform should be retrieved. The selection of the desired segment waveform may be achieved by programming it in the sound synthesis program in an arbitrary manner, or the segment waveform may be freely selected by the user's manual operation. For example, there may be a case where, depending on the nature of a sound to be synthesized, it is preferable to loop the waveform corresponding to the middle portion or the end portion of the sound. Further, which portion should be looped may be determined in consideration of the user's taste or the taste of a person making the sound synthesis program. Generally speaking, the looping tends to make a sound more or less monotonous, and therefore, it may be preferable to retrieve, as the looping segment, the segment of a rather unimportant portion of the sound which does not remarkably characterize the sound. Of course, the segment of an important portion remarkably characterizing the sound may be retrieved as the looping segment. Note that the segment waveform data retrieved for looping are all of the SMS data, namely, the frequency and magnitude trajectories and the stochastic waveform data.

In step 134, a process is performed for inserting the segment waveform retrieved in the foregoing manner, into a sound waveform to be synthesized. For instance, the SMS data of a desired waveform (e.g. a waveform of the attack portion, or a waveform of the attack portion and a following appropriate portion) in the original sound waveform up to the beginning of looping are retrieved from the data memory 100 and then written, as a new waveform data file, into another storage location or into any other suitable memory. Then, following the already-written preceding waveform data, the SMS data of the retrieved segment waveform are repeatedly written a desired number of times. It is assumed that an appropriate smoothing operation is performed to achieve a smooth data connection or joint when inserting or repeating the segment waveform. The smoothing operation may, for example, be an interpolation operation applied to the connecting point, or any other suitable operation which will allow the last data of the preceding waveform to match the head data of the succeeding waveform. Of the SMS data, the deterministic component data are processed by the smoothing operation, but the stochastic component data requires no such smoothing operation. After the segment waveform has been repeatedly inserted a sufficient number of times for the time length to be extended, the remaining SMS data of the original waveform are inserted and written into the memory as the last data portion. Also in this case, the above-mentioned smoothing operation is applied in order to allow a smooth connection between the preceding and succeeding data.

The above-mentioned insertion process of step 134 is performed out of real-time with respect to the sound generation. That is, a waveform having a duration extended to a desired length is prepared, and then the waveform data are written, as a new waveform data file, into a new storage location of the data memory 100 or into any other suitable memory. In such a case, a sound having the extended duration can be synthesized by sequentially reading out the waveform data from the memory only once when reproductively generating the sound. However, alternatively, by a technique known as the looping process in synthesizers etc., a similar process to the above-mentioned insertion process of step 134 may be performed on the real-time basis in generating the sound. In such a case, the process of repeatedly writing the segment waveform is not necessary, and it may suffice to receive, from the process of step 133, data designating a segment waveform to be looped and to repeatedly read out the segment waveform data from the data base storing the original sound.

In a modified example of the present invention, the segment waveform that is additionally repeated to extend the duration may comprise plural segments instead of a single segment. Further, one segment may correspond to plural cycles of a vibrato.

Next, description will be made on the sub-algorithm for shortening the duration.

The shortening sub-algorithm is based on the removal or deletion of sound segment. To this end, the sub-algorithm executed in the shortening process of step 135 examines the time interval of pairs of two local maxima or of two local minima in the frequency trajectory and thereby finds a pair suitable for the time length that is desired to be deleted. For this purpose, a list of the local maxima and the local minima may be prepared, and the extremum pair suitable for the time length to be deleted may be found with reference to this list. As such a list, the extremum list may be used which is based on the 7 point average file. In such a case, the extremum list may be the one either before or after the edit process of step 131.

Figure 26:
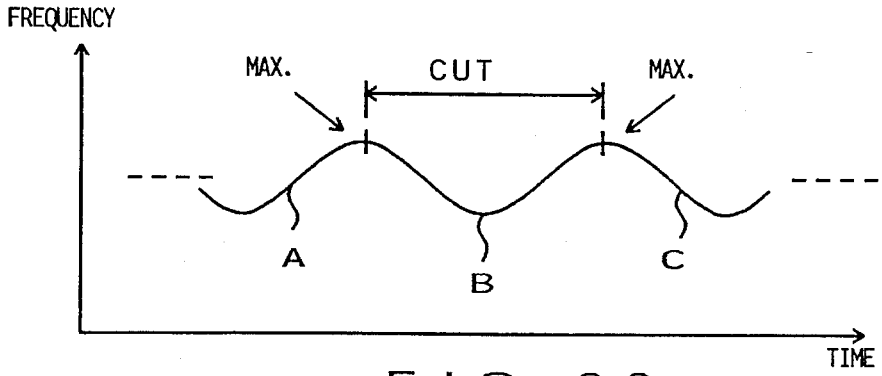
FIG. 26 illustrates an example case in which a deleting portion for shortening the sound duration is analyzed in the example of FIG. 25.
Figure 27:
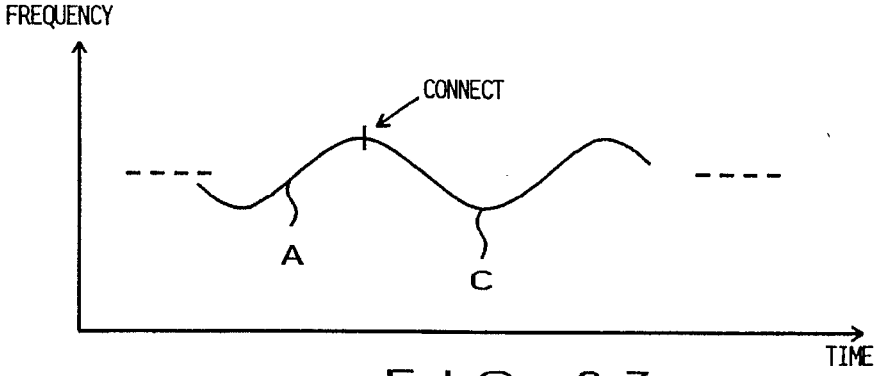
FIG. 27 illustrates an example of data of which duration time has been shortened by removing the deleting portion from waveform data, in the example of FIG. 25.

More specifically, the sub-algorithm starts searching the extremum list in the time progressing direction from the middle part of the note, in order to find the pair of two local maxima or the pair of two local minima that is suitable for the time length to be deleted. Thus, the extremum pair best fit for the time length to be deleted can be selected. If the time interval of the extremum pair having the greatest time interval is shorter than the time length to be deleted, that extremum pair is selected to be deleted. Then, as shown in FIG. 26, a process is performed for deleting, from the original SMS data trajectories A, B, C, . . . , trajectory portion B between the extremum pair having been selected to be deleted. That is, SMS data trajectory portion A before the first extremum of the selected extremum pair is retrieved from the data memory 110 and written as a new waveform data file into a new storage location of the memory 110 or into any other suitable memory. Then, SMS data trajectory portion C after the second extremum of the selected extremum pair is retrieved from the data memory 110 and additionally written into the new waveform data file next to the already-written trajectory portion A. For splicing the SMS data trajectory portions A and C, a smoothing operation similar to the above-mentioned is performed. Thus, as shown in FIG. 27, a new SMS data file without the trajectory portion B is prepared. Of course, the deletion is made of all of the SMS data (frequency, magnitude, phase and stochastic components). Further, the waveform shortening time may be selected as desired by the user.

The above-mentioned shortening process of step 135 is performed out of real-time with respect to the sound generation. That is, a waveform of a duration extended as desired is prepared, and the waveform data are written, as a new waveform data file, into a new storage location of the data memory 100 or into any other suitable memory. Alternatively, a similar process to the above-mentioned shortening process of step 135 may be performed on the real-time basis in synthesizing a sound, in which case it suffices to search for a segment to be deleted beforehand so that, after the trajectory portion A has been read out for generating a sound, the sub-algorithm jumps to read out the trajectory portion C without reading out the trajectory portion B which corresponds to the segment to be deleted. Also in such a case, it is preferable to perform an arithmetic operation for providing a smooth joint between the end of the trajectory portion A and the head of the trajectory portion C.

In the foregoing example, the duration lengthening or shortening waveform segment is searched using the extrema in the frequency trajectory (namely, vibrato). Instead, the search may also be made using the extrema in the magnitude trajectory. Further, for finding the duration lengthening or shortening waveform segment, any other index other than the extrema may be employed.

Just like the above-mentioned other controls, this time modification control can be applied not only to the SMS technique but also to other similar partial additive synthesis techniques.

Pitch Analysis and Synthesis

Analyzing the pitch of the original SMS data is very important, in order to allow a sound to be synthesized with a desired variable pitch. Namely, as long as the pitch of the original SMS data has been identified, the frequency data of the original SMS data can be modified so as to correspond to a desired reproduction pitch, by designating the desired reproduction pitch and controlling each frequency data in accordance with the ratio between the desired pitch and the original pitch. Thus, while having a capability of completely reproducing a sound having the characteristics of the original SMS data, the modified SMS data will have the desired pitch different from the original pitch. Therefore, the pitch analysis/synthesis algorithm permitting this is very important to music synthesizers employing the SMS technique. A specific example of the pitch analysis/synthesis algorithm will be described below. The pitch analysis algorithm is executed in the SMS data processor 30 (FIG. 2), while the pitch synthesis algorithm is executed in the reproduction processor 50 (FIG. 4).

Pitch Analysis Algorithm

Figure 28:
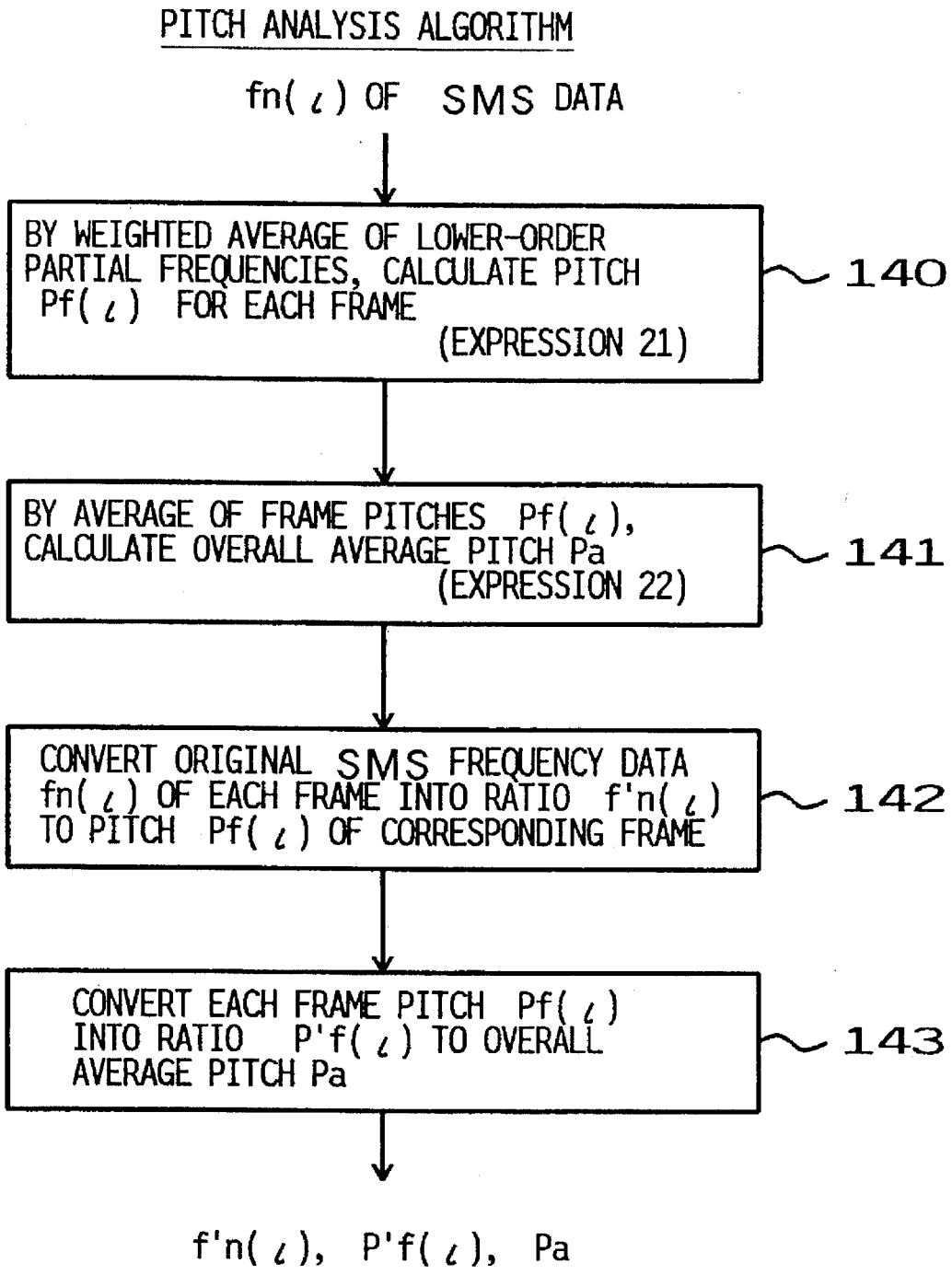
FIG. 28 is a block diagram illustrating an embodiment of a pitch analysis algorithm in accordance with the present invention.

FIG. 28 illustrates a specific example of the pitch analysis algorithm.

First, the pitch of every frame Pf(ι) is calculated from the frequency trajectory of the original SMS data in accordance with the following expression:

$$Pf(\iota)=\frac{\sum_{n=0}^{Np-1} an(\iota)\frac{fn(\iota)}{n+1}}{\sum_{n=0}^{Np-1} an(\iota)} \qquad \text{(Expression 21)}$$

where ι is the frame number indicative of a specific frame, Np is the number of partials used in the pitch analysis, and n is a variable indicative of the respective orders of the partials which varies like n=0, 1, . . . , Np. an(ι) and fn(ι) are the amplitude magnitude and frequency of the nth partial in the deterministic component for frame ι. The Expression 21 is intended for weighting the frequencies fn of Np lower-order partials with respective reciprocals 1/(n+1) of the frequency orders and amplitude magnitudes an and thereby calculating their weighted average. By this weighted average, the pitch Pf can be detected relatively accurately. For example, a good result can be obtained if the above-mentioned weighted average for 6 lower-order partials is calculated on the assumption of Np=6. Alternatively, Np=3 may be used. According to a simpler approach, the frequency f0(ι) of the lowest-frequency the frame in question. However, detecting the pitch by partial may be detected as the pitch Pf(ι) of the frame in question. However, detecting the pitch by the weighted average as mentioned above is better suited to the human hearing sense than this simpler approach.

Figure 30:
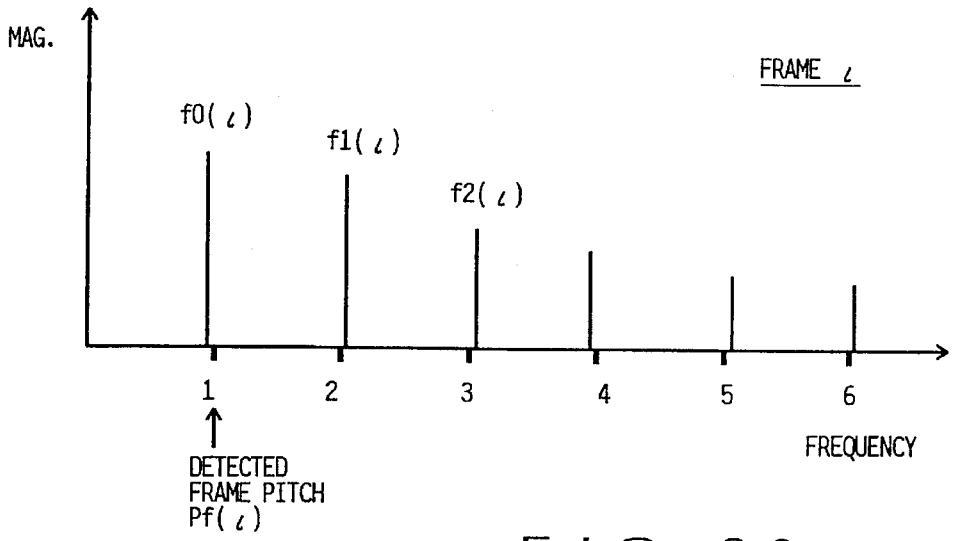
FIG. 30 is a spectrum diagram explanatory of a manner in which a pitch is detected for a given frame in accordance with the pitch analysis algorithm of FIG. 28.

FIG. 30 schematically illustrates the manner in which the frame pitch Pf(ι) is detected in accordance with the above-mentioned weighted average calculation. Number "1"shown in the horizontal frequency axis represents the frequency location of the detected frame pitch Pf(ι), "2, 3, 4, . . . " represent the locations of frequencies that are two times, three times, four times the detected frame pitch Pf(ι), respectively. These frequency locations are exactly in integer multiple relations. The illustrated line spectrum is of the original frequency data fn(ι). The line spectrum fn(ι) of the original sound is not in an exact integer multiple relation. The figure shows that the frequency locations of the pitch obtained by the weighted average are somewhat different from those of the frequency f0(ι) of the first partial.

Then, in accordance with the following expression, the overall average pitch Pa is obtained by calculating the average of the pitches Pf(ι) of the frames within a predetermined frame range (step 141). In the expression, L is the number of frames within the predetermined frame range. As the predetermined frame range, it is preferable to select an appropriate period when the pitch of the original sound is caused to stabilize.

$$Pa=\frac{1}{L}\sum_{\iota=0}^{L-1} P(\iota) \qquad \text{(Expression 22)}$$

After that, the frequency data fn(ι) of each frame in the original SMS data are converted into data f'n(ι) expressed by the ratio to the pitch Pf(ι) of the frame in question as follows (step 142).

$$f'n(\iota)=fn(\iota)\ /\ Pf(\iota) \qquad \text{(Expression 23)}$$

where n=0, 1, 2, . . . , N−1.

Then, the pitch Pf(ι) of each frame is converted into data P'f(ι) expressed by the ratio to the overall average pitch Pa as follows (step 143):

$$P'f(\iota)=Pf(\iota)\ /\ Pa \qquad \text{(Expression 24)}$$

By the data conversion processes using the Expressions 23 and 24, the SMS frequency data can be compressed and converted into data representations that are easy to process during modification controls in the rear stage.

In this way, the absolute frequency data fn(ι) in the original SMS data are converted into relative frequency data group, namely, a relative frequency trajectory f'n(ι) and a frame pitch trajectory P'f(ι) for each partial and one overall average pitch data Pa. These converted frequency data f'n(ι), P'f(ι), Pa are stored as the SMS frequency data into the data memory 100.

Pitch Synthesis Algorithm

Figure 29:
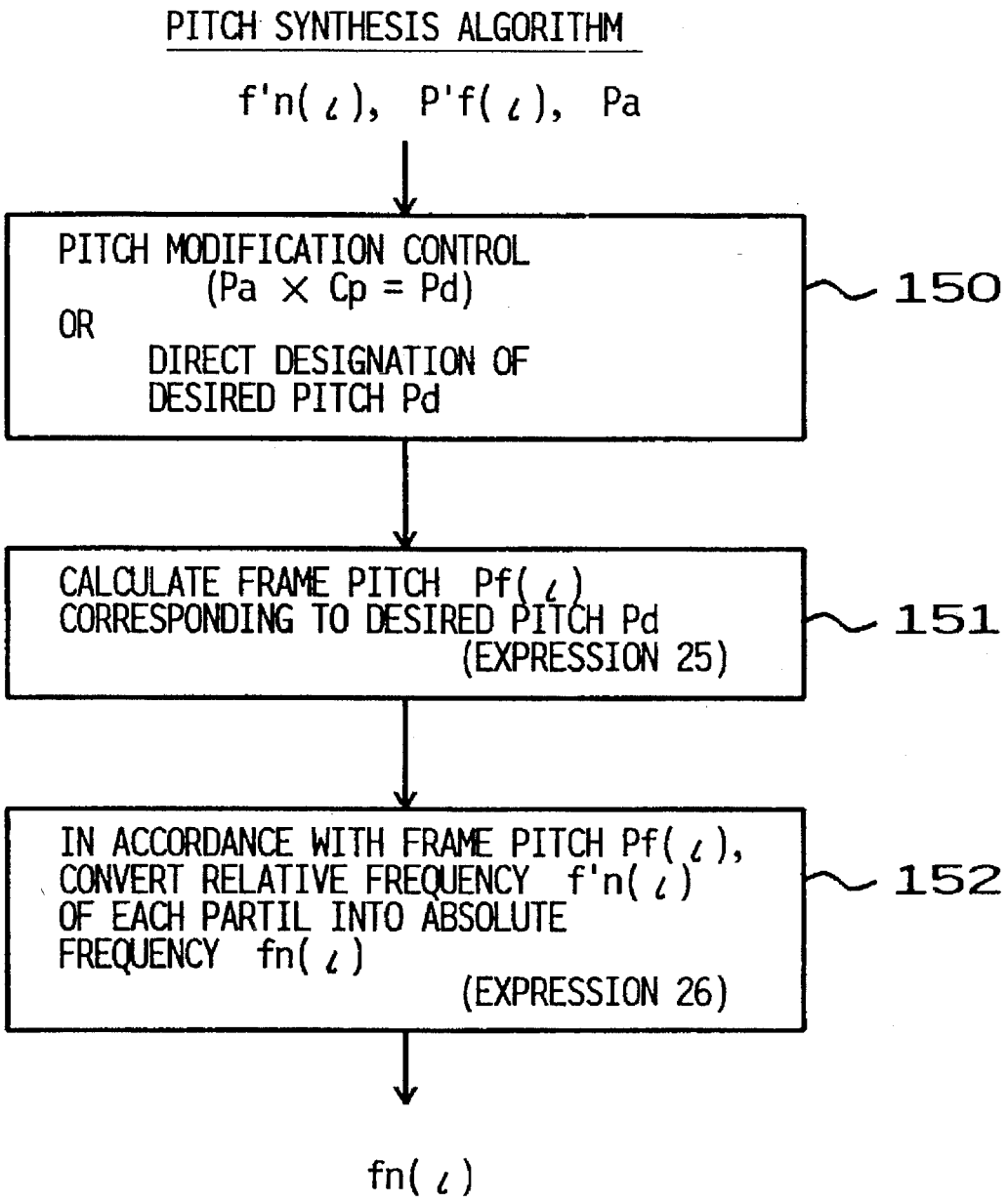
FIG. 29 is a block diagram illustrating an embodiment of a pitch synthesis algorithm in accordance with the present invention.

FIG. 29 illustrates an example of the pitch synthesis algorithm, which, for synthesizing a sound, receives the modified SMS frequency data group f'n(ι), P'f(ι), Pa read out from the data memory 100 and processes the received data as follows.

First, in step 150, a process is performed in response to the user's operation to control the pitch of a sound to be synthesized. For example, a pitch control parameter Cp is generated and the overall average pitch data Pa is modified (for example, multiplied) by this pitch control parameter Cp, so as to produce data Pd designating an overall pitch of a reproduced sound. Alternatively, the overall pitch designating data Pd may be produced in direct response to the user's operation. As is well known, pitch designating or pitch controlling factors responsive to the user's operation may contain control factors such as a scale tone designation by a keyboard etc. or a pitch bend.

Next, in step 151, the desired pitch Pd determined in the foregoing manner is substituted by the obtained overall average pitch Pa and arithmetically operated with the relative frame pitch P'f(ι) in accordance with the following expression, to thereby perform the inverse operation of the Expression 24 above to obtain a new pitch Pf(ι) of each frame which is determined in correspondence to the desired pitch Pd.

$$Pf(\iota)=P'f(\iota)*Pd \qquad \text{(Expression 25)}$$

Next, in step 152, the new frame pitch Pf(ι) obtained in the foregoing manner is arithmetically operated with the relative frequency data f'n(ι) of each partial of the frame in accordance with the following the expression, to thereby perform the inverse operation of Expression 23 above to obtain the absolute frequency data fn(ι) of each partial of each frame which is determined in correspondence to the desired pitch Pd. Here, n=0, 1, 2, . . . , N−1.

$$fn(\iota)=f'n(\iota)*Pf(\iota) \qquad \text{(Expression 26)}$$

Thus, there is obtained a frequency trajectory fn(ι) represented in absolute frequency corresponding to the pitch Pd desired by the user. The SMS sound synthesizer 110 performs a sound synthesis on the basis of the SMS data containing this pitch-modified frequency trajectory fn(ι), so that there can be obtained a sound on which a desired pitch control has been performed. The harmonic structure of the reproduced sound, unless a specific control is made thereto, is of high quality which allows a faithful approximation of the harmonic structure f0(ι), f1(ι), f2(ι), . . . of the original sound (which allows a faithful approximation of subtle frequency shifts peculiar to natural sound). Also, because each data is represented in a relative value, processing operations for modifying the harmonic structure etc. can also be done relatively easily.

Further, simultaneously with the above-mentioned control of the deterministic component in accordance with the desired pitch Pd, another control may be done for compressing or expanding, in the frequency direction, the stochastic envelopes for use in the SMS sound synthesis in accordance with the desired pitch Pd.

Like the above-mentioned other controls, the foregoing pitch analysis and synthesis are applicable not only to the SMS technique but also to other similar partial additive synthesis techniques.

Phase Analysis and Synthesis

Phase data of the deterministic component are not essential to the SMS technique, but a sound synthesis considering such phase data provides a even better quality of synthesized sounds. In particular, it is preferable to perform an appropriate phase control because it effectively adds to the quality of sounds. Further, without any consideration of phase, it is difficult to perform pitch modifications and other conversions such as time expansion with phase included. Therefore, a novel algorithm for analysis and synthesis of the phase data of the deterministic component will be proposed as follows.

The phase trajectory in the analyzed SMS data is denoted by ϕn(ι). ι is the frame number, and n is the order of a partial. The phase value ϕn in this phase trajectory ϕn(ι) is an absolute value of the initial phase of each partial n. According to the novel phase analysis algorithm, the phase value ϕn is represented by a relative value θn(ι) to the first partial, i.e., fundamental component as shown in the following expression. This calculation is done in the SMS data processor 30.

$$\theta n(\iota)=\frac{\phi n(\iota)}{fn(\iota)/fo(\iota)}-\phi o(\iota) \qquad \text{(Expression 27)}$$

That is, the relative phase value θn(ι) of a certain partial is obtained by dividing the corresponding absolute phase value ϕn(ι) by the ratio of the corresponding partial frequency fn(ι) to the first partial frequency f0(ι) and then subtracting the first partial absolute phase value ϕo(ι) from the quotient. Namely, the phases of the higher-order partials are less important and hence are weighted accordingly; this is why the phase value ϕn(ι) is represented in relative value to the phase of the first partial. In this way, the phase trajectory ϕn(ι) is converted into a relative phase trajectory θn(ι) of smaller value and is stored into the data memory 100 in this state. Therefore, the phase data can be stored in compressed form. Further, the relative phase θo(ι) of the first partial need not be stored since it is always zero.

The following expression is applied to resynthesize the absolute phase trajectory ϕn(ι) on the basis of the above-mentioned relative phase trajectory θn(ι). This calculation is performed in the reproduction processor 50.

$$\theta' n(\iota)=[fn(\iota)/f\mathbf{0}(\iota)]*[\theta n(\iota)+\phi'\mathbf{0}(\iota)] \qquad \text{(Expression 28)}$$

Basically, the Expression 28 is the inverse of the Expression 27. However, θ'(ι) corresponds to the absolute phase value of the first partial and is controllable by the user's operation or by any suitable reproduction program. If, for example, ϕ'0(ι)=ϕ0(ι), the resulting phase trajectory ϕ'n(ι) will be the same as the original phase trajectory ϕn(ι). Further, if ϕ'0(ι)=0, the initial of the fundamental component (first partial) in the synthesized tone will be zero.

In the SMS sound synthesizer 110, this phase trajectory ϕ'n(ι) is used for setting the initial phases of sinusoidal waveforms corresponding to the individual partials when sinusoid-synthesizing the deterministic component of the SMS data. For instance, the sinusoid waveforms corresponding to the individual values of n (n=0,1,2, . . . , N−1) may be represented as an sin [2πfn(ι)t+ϕ'n(ι)]

and they may be added up to provide a synthesized sound.

In order to achieve an accurate phase resynthesization calculation, it is necessary to execute a cublic polynomial for each sample of every partial. However, such an execution of the cublic polynomial is undesirable in that it is time-consuming and troublesome. So, a method will be proposed below which is not time-consuming, yet allows a relatively accurate phase resynthesization calculation.

The proposed approach involves a sort of interpolation operation that modifies the frequency trajectory by the use of the phase trajectory. Here, the frequency at the start of a frame is denoted by fs, the frequency at the end of a frame is denoted by fe, the phase at the start of a frame is denoted by ϕs, and the phase at the end of a frame is denoted by ϕe. If the frequency is simply interpolated linearly, the phase at the frame end ϕi may be represented as $$\phi i=[(fs+fe)/2]*\Delta t+\phi s \qquad \text{(Expression 29)}$$

where Δt is the time size of a synthesis frame. (fs+fe)/2 is a simple average between the start frequency fs and the end frequency fe, and the simple average as multiplied by Δt represents the frequency at Δt and corresponds to the phase. Namely, it corresponds to the total phase amount that has progressed in one frame having time Δt. Therefore, ϕi represents the final phase obtained by a simple interpolation. Next, a simple average between ϕe and ϕi is obtained as follows, and the obtained simple average is determined as a target phase ϕt.

$$\phi t=(\phi e+\phi i)/2 \quad \text{(Expression 30)}$$

From this target phase ϕt, a target frequency ft is obtained in accordance with:

$$ft=2(\phi t-\phi s)/66\ t-fs \quad \text{(Expression 31)}$$

where ϕt−ϕs corresponds to a total phase amount that progresses in one frame having time Δt when the target phase ϕt, and (ϕt−ϕs)/Δt corresponds to the frequency of that frame. The foregoing Expression 31 obtains ft on the assumption that this frequency corresponds to the simple average between the start frequency fs and the target frequency ft.

A desired phase synthesis can be made with a considerable accuracy if the individual frequency data are interpolation-operated taking into account the phase data for each partial and a sinusoid synthesis is made using the resulting interpolated frequency data.

Again, like the above-mentioned other controls, the foregoing phase analysis and synthesis can be applied not only to the SMS technique but also to other similar partial additive synthesis techniques.

Frequency and Magnitude De-trending Process

The outline of the de-trending process was described earlier in connection with step 32 of FIG. 3. Here, a specific example of the de-trending process will be described in greater detail.

The de-trending process is performed on the fundamental frequency of each frame (which may be either the frequency of the first partial Pf(ι) or the frame pitch f0(ι) analyzed by the above-mentioned pitch analysis) in the frequency trajectory, the average magnitude (magnitude average of all the deterministic partials) of each frame in the magnitude trajectory, and the stochastic gain (gain data indicative of the overall level of the residual spectral envelope) of each frame in the stochastic trajectory. These three de-trending process objects will hereafter be referred to as elements.

First, with respect to the steady state of a sound, a slope b representative of the time-varying change trend of every element is calculated in accordance with the following equation so as to detect the change trend of the element:

$$b=(ye-y0)/(xe-x0) \quad \text{(Expression 32)}$$

where y represents the value of the element whose time-varying change trend is to be analyzed in accordance with this equation, and y0 and ye represent the processed element values at the beginning and the end of the steady state, respectively. x represents the frame number (namely, time), and x0 and xe represent the frame numbers at the beginning and the end of the steady state, respectively. As may be apparent, the slope b corresponds to a tilt coefficient in primary function representative of the variation trend.

After the slope b is calculated, a de-trend value di for each frame unit is calculated, in accordance with the following expression, in correspondence with every frame x0, x1, x2, . . . , xe in the steady state:

$$di=(xi-x0)*b \quad \text{(Expression 33)}$$

where xi is the current frame number and is a variable for i=0, 1, 2, . . . , e.

Then, the thus-obtained de-trend value di for each frame unit is subtracted from the SMS data corresponding to the element, to thereby perform the de-drending process. That is, there is obtained flattened SMS data from which the variation trend has been removed (however, the vibrato, tremolo and other micro-variations of the sound are left unremoved). The subtraction of the de-trend value di for the frequency element is made as follows. Because this de-trend value di is calculated on the basis of the fundamental frequency, the number n of every partial of the frame (to be more exact, it may be the ratio of every partial to the first partial frequency, i.e., fundamental frequency) is multiplied by the de-trend value di, and the resulting product n * di (n=1, 2, . . . N) is subtracted from the corresponding partial frequency. As for the magnitude element, the de-trend value di is subtracted from the magnitude value of every partial of the frame. Further, as for the stochastic gain, the de-trend value di is subtracted from the stochastic gain value of the frame.

The de-trended SMS data may be stored into the data memory 100 without modifications and read out for use in the sound synthesis. When synthesizing a sound from the de-trended SMS data, it is normally unnecessary to resynthesize the original trend and impart it to the sound; that is, it is sufficient to synthesize the sound lust as de-trended. However, in the case where it is desired to synthesize a sound completely equipped with the original trend, the original trend may be resynthesized in an appropriate manner.

In an alternative arrangement, the de-trended SMS data may be utilized as the object of the above-mentioned formant analysis, vibrato analysis and various other anlayses.

This de-trending process is not necessarily essential to the SMS analysis and synthesis and therefore may be omitted if appropriate. However, for example, in the case where the looping process for extending the duration of sound is performed, the de-trending process is very useful in that it effectively achieves a unnaturalness-free, i.e., natural looping (repetition of a segment waveform). In other words, this de-trending process may be performed merely as a subsidiary process that is directed only to preparing SMS data of the looping segment waveform).

Again, like the above-mentioned other controls, this de-trending process is also applicable not only to the SMS technique but also to other sound synthesis techniques.

Improvements for Singing Synthesizers

The synthesizer described in this embodiment is suitable for synthesizing human voices or vocal phrases in various applications such as the foregoing formant analysis/synthesis (control included) technique, vibrato analysis/synthesis (control included) technique, and various data interpolation techniques employed in data reproduction/synthesis step for note transfer.

Next, description will be given on further improvements for application as a singing synthesizer. The following improvements are on the SMS analysis process performed in the SMS analyzer 20 (FIG. 2).

Pitch Synchronous Analysis:

One of the characteristics of the singing voice synthesizer using the SMS technique is that it is allowed to achieve a free synthesis of a singing voice with enhanced controllability by inputting, as an original sound, an actual singing voice (human voice) from the outside, analyzing the input original sound to create SMS data and performing an SMS syntheses after processing the SMS data in an unconstrained manner.

Here, an improved SMS analysis is proposed which is particularly useful in the case where an actual singing voice is input as the original sound.

One of the major characteristics of the singing voice is its rapid and continuous pitch changing nature. To improve the accuracy of the analysis, it is preferable to change the analysis frame size depending on the current pitch of the input original sound (i.e., pitch synchronous analysis). It is assumed here that the frame rate is not changed. To change the frame size means to change the time length of signal to be input for one SMS analysis. To this end, the following steps for stochastic analysis are executed as a part of the SMS analysis:

First Step: The fundamental frequency of the input original sound is obtained from the analysis result of the previous frame.

Second Step: The current frame size is set depending on the last frame's fundamental frequency (for example, four times the period length).

Third Step: The residual signal is obtained by a time-domain subtraction.

Fourth Step: The stochastic analysis is performed from the time-domain residual signal.

In the first step, the fundamental frequency of the input original sound is easily obtained in the SMS analysis. For example, the fundamental frequency may be either the first partials frequency $f0(\iota)$ or the frame pitch $Pf(\iota)$ obtained from the afore-mentioned pitch analysis. The second step requires a flexible analysis buffer such that each frame can be of a different size. The stochastic analysis of the third and fourth steps is performed using the thus-set frame size. The third step reproduces the deterministic component signal, which is then subtracted from the original signal to obtain the residual signal. The fourth step obtains data of the stochastic component from the residual signal.

Such a stochastic analysis is advantageous in that it allows the frame size for the stochastic analysis to be different from the one for the deterministic component analysis. If the stochastic analysis frame size is smaller than the one for the deterministic component analysis, time resolution in the stochastic analysis result will be improved, which will result in better time resolution in sharp attacks.

Preemphasis Process:

To improve the accuracy of the SMS analysis, it is useful to perform a preemphasis process on the input vocal signal before the SMS analysis. Then, a deemphasis process corresponding to the preemphasis process is performed at the end of the SMS analysis. Such a preemphasis process is advantageous in that it permits an analysis of the partials of higher frequency.

High-Pass Filter Process for Residual Signal:

The stochastic component of the singing voice is generally of high frequency. There is very few stochastic signal below 200 Hz. Thus, it is useful to apply a high-pass filter to the residual signal before performing the stochastic analysis by subtracting the SMS-analyzed deterministic component signal from the original sound signal.

Apart from the foregoing, the subtraction of the deterministic component signal from the original sound signal has some problems due to the fast pitch variation typical to the voice. To address such problems, it is useful to employ the high-pass filter. A typical cutoff frequency of the high-pass filter may preferably be set around 800 Hz. A compromise such that this filtering does not subtract the actual stochastic signal is to change the cutoff frequency of the high-pass filter depending on the part of the sound to be analyzed at a given moment. For example, in a section of the sound with a lot of deterministic component but little stochastic component, the cutoff frequency can be set higher. Conversely, in a section of the sound with a lot of stochastic component, the cutoff frequency must be set lower.

Specific Example of Vocal Phrase Synthesis

In order to synthesize a vocal phrase using the foregoing synthesizer of the present invention, the first step is to prepare a data base composed of plural phonemes and diphones. To this end, sounds of various phonemes and diphones are input for SMS analysis to thereby prepare SMS data corresponding to the input sounds, which are then respectively stored into the data memory 100 so as to prepare the data base. Then, on the basis of the user's controls, the SMS data of plural phonemes and/or diphones required for making up a desired vocal phrase are read out from the prepared data base, and the read-out SMS data are combined in time series to form SMS data that correspond to the desired vocal phrase. The combination of the SMS data corresponding to the prepared vocal phrase may be stored into a memory so that it is read out when desired for use in a sound synthesis of the vocal phrase may be done by performing a real-time SMS-synthesis of a sound that corresponds to the combination of the SMS data corresponding to the prepared desired vocal phrase.

In analyzing the input sound, the SMS analysis may be performed assuming that the input sound is a single phoneme or diphone. Frequency components in a single phoneme or diphone are easy to analyze because they do not change so much during the steady state of the sound. Therefore, if a certain desired phoneme is to be analyzed, it will be sufficient to input a sound which exhibits the characteristics of the phoneme during the steady state of the sound.

In analyzing such a phoneme or diphone, i.e., analyzing human voice, executing various improvements thus-far described in this specification (formant analysis, vibrato analysis etc.) along with the conventionally-known SMS analysis is extremely useful for analysis and subsequent unconstrained variable synthesis of human voice.

Logarithmic Representation of SMS Data

In the past, frequency data in SMS data is in linear representation corresponding to herz (Hz) or radian. However, the frequency data may be in logarithmic representation, in which case simpler additive calculations can replace the above-mentioned various calculations such as the frequency data multiplications in the pitch-modifying operations.

Smoothing of Stochastic Envelope

One way to calculate stochastic representation data of a given sound is by a line segment approximation of the residual spectral envelope. Once the frequency envelope of the stochastic data is calculated, this envelope may advantageously be smoothed by being processed by a low-pass filter. This low-pass filter process can smooth a synthesized noise signal.

Application to Digital Waveguide

Figure 31:
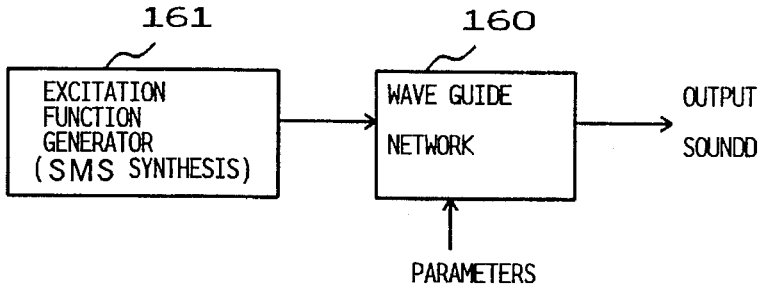
FIG. 31 is a block diagram illustrating an embodiment in which the SMS technique of the present invention is applied to a tone synthesis based on the digital waveguide theory.

It is known to synthesize a sound in accordance with the digital waveguide theory (for example, U.S. Pat. No. 4,984,276). The known technique is schematically illustrated in FIG. 31, in which an excitation function signal generated from an excitation function generator 161 is input to a closed waveguide network 160, so that the input excitation function signal is processed in the waveguide network 160 in accordance with stored parameters, to thereby obtain an output sound of a desired tone color as established by the stored parameters. As a possible application of the SMS technique to a tone synthesis based on the digital waveguide theory, there may be considered a method in which the excitation function generator 161 is constructed of an SMS sound synthesis system so that an SMS-synthesized sound signal is used as an excitation function signal for the waveguide network 160.

Figure 32:
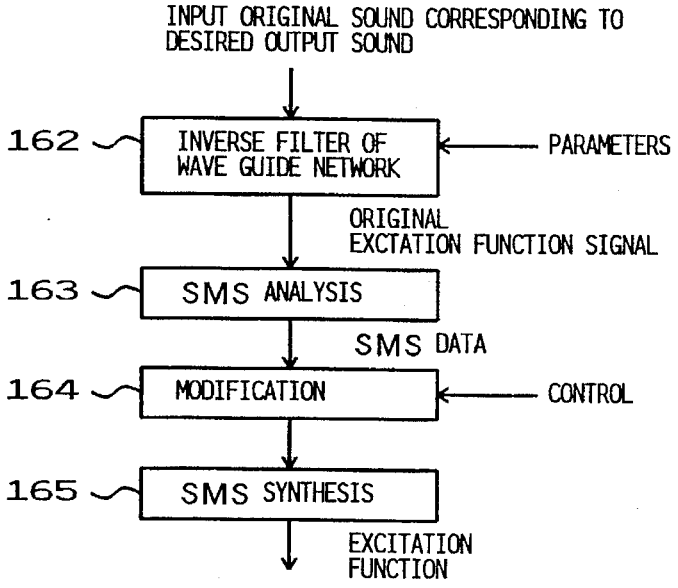
FIG. 32 is a block diagram illustrating an example application of the SMS analysis/synthesis technique to an excitation function generator of FIG. 31.

As a more specific example, there may be considered a method in which an excitation function signal for the waveguide network 160 is SMS-synthesized in accordance with a procedure as shown in FIG. 32. First, an original sound signal corresponding to a desired sound to be output from the waveguide network 160 is processed by an inverse filter circuit that is set to have characteristics opposite to filtering characteristics established in the waveguide network 160 (step 160). The output from the inverse filter circuit corresponds to a desired excitation function signal. After that, the desired excitation function signal is analyzed by an SMS analyzer (step 163), to thereby obtain corresponding SMS data. The SMS data are stored in a suitable manner. Then, the SMS data are read out, modified in response to the user controls if necessary (step 164), and then used to synthesize a sound in the SMS synthesizer (step 165). The resulting sound signal is input, as the excitation signal, to the waveguide network 160.

The advantage of such a method is that desired sound can be synthesized by modifying the excitation function signal derived from the SMS synthesis without changing the parameters in the waveguide network 160. This simplifies an analysis of the parameters in the network 160. That is, desired variable controls for synthesizing sounds can be achieved to a considerable extent just by modifying the SMS data, in correspondence to which it is allowed to effectively simplify the parameter analysis for variable controls in the waveguide network.

What is claimed is:

1. A method of analyzing and synthesizing a sound, comprising:

a first step of providing analysis data based on an analysis of an original sound, said analysis data being indicative of plural components making up a waveform of the original sound;

a second step of analyzing, from said analysis data, a characteristic concerning a predetermined sound element so as to extract data indicative of the analyzed characteristic as a sound parameter, the extracted sound parameter denoting a property of said element in the original sound;

a third step of removing from said analysis data the characteristic corresponding to said extracted sound parameter;

a fourth step of adding a processed characteristic corresponding to said sound parameter to said analysis data from which said characteristic has been removed; and a fifth step of synthesizing a sound waveform on the basis of said analysis data to which said processed characteristic has been added.

2. A method of analyzing and synthesizing a sound as defined in claim 1 wherein said fourth step includes a step of modifying said sound parameter, said processed characteristic corresponding to the modified sound parameter being added to said analysis data.

3. A method of analyzing and synthesizing a sound as defined in claim 1 which further comprises a step of storing into a memory said analysis data and said sound parameter.

4. A method of analyzing and synthesizing a sound as defined in claim 1 wherein said sound parameter is represented in a data representation form different from that of said analysis data.

5. A method of analyzing and synthesizing a sound as defined in claim 1 wherein said fourth step includes a step of making, on the basis of said sound parameter, additional data in a data representation form corresponding to that of said analysis data.

6. A method of analyzing and synthesizing a sound as defined in claim 1 which further comprises a step of, before said fourth step, interpolating between said analysis data corresponding to at least two different sounds or sound portions and also interpolating between the sound parameters corresponding to said at least two different sounds or sound portions.

7. A method of analyzing and synthesizing a sound as defined in claim 1 wherein said analysis data contain data indicative of frequencies and magnitudes of partials making up the waveform of the original sound.

8. A method of analyzing and synthesizing a sound as defined in claim 1 wherein said analysis data contain data of a deterministic waveform component denoting the frequencies and magnitudes of the partials making up the waveform of the original sound, and stochastic data corresponding to a residual waveform component of said waveform of the original sound.

9. A method of analyzing and synthesizing a sound as defined in claim 1 wherein in said first step, there are provided the analysis data for each time frame which are obtained by analyzing the original sound at different time frames, and in said second step, said sound parameter is extracted for each said time frame on the basis of said analysis data of each said time frame.

10. A method of analyzing and synthesizing a sound as defined in claim 1 wherein in said first step, there are provided analysis data for each time frame which are obtained by analyzing the original sound at different time frames, and in said second step, said sound parameter which is common to a plurality of the time frames is extracted on the basis of said analysis data of each said time frame.

11. A method of analyzing and synthesizing a sound as defined in claim 1 wherein said characteristic corresponding to said sound parameter relates to a frequency component, and removal of said characteristic from said analysis data in said third step comprises modifying frequency data in said analysis data.

12. A method of analyzing and synthesizing a sound as defined in claim 1 wherein said characteristic corresponding to said sound parameter relates to a magnitude component, and the removal of said characteristic from said analysis data in said third step comprises modifying magnitude data in said analysis data.

13. A method of analyzing a sound, comprising:

a first step of providing analysis data based on an original sound, said analysis data being indicative of plural components making up a wave form of the original sound;

a second step of analyzing, from said analysis data, a characteristic concerning a predetermined sound element so as to extract data indicative of the analyzed characteristic as a sound parameter, the extracted sound parameter denoting a property of said element in the original sound; and a third step of removing from said analysis data the characteristic corresponding to said extracted parameter, the waveform of the original sound being represented by a combination of said analysis data from which said characteristic has been removed and said sound parameter.

14. A method of analyzing a sound as defined in claim 13 which further comprises a step of storing into a memory said analysis data and said sound parameter.

15. A method of analyzing and synthesizing a sound as defined in claim 13 wherein said analysis data contain data of a deterministic waveform component indicative of frequencies and magnitudes of partials that make up the waveform of the original sound, and stochastic data corresponding to a residual waveform component of said waveform of the original sound.

16. A method of analyzing and synthesizing a sound, comprising:

a first step of providing analysis data based on an analysis of an original sound, said analysis data being indicative of plural components making up a waveform of the original sound;

a second step of analyzing, from said the analysis data, a characteristic concerning a predetermined sound element so as to extract data indicative of the analyzed characteristic as a sound parameter, the extracted sound parameter denoting a peculiar property concerning said element in the original sound;

a third step of modifying said sound parameter;

a fourth step of adding the characteristic corresponding to said sound parameter to said analysis data; and a fifth step of synthesizing a sound waveform on the basis of said analysis data to which said characteristic has been added.

17. A method of analyzing and synthesizing a sound as defined in claim 16 wherein said analysis data contain data of a deterministic waveform component indicative of frequencies and magnitudes of partials that make up the waveform of the original sound, and stochastic data corresponding to a residual waveform component of said waveform of the original sound.

18. A sound waveform synthesizer comprising:

analyzer means for providing analysis data indicative of plural components making up a waveform of an original sound, said analysis data being obtained from an analysis of the original sound;

data processing means for analyzing, from the analysis data, a characteristic concerning a predetermined sound element so as to extract data indicative of the analyzed characteristic as a sound parameter, and removing from said analysis data the characteristic corresponding to the extracted sound parameter;

storage means for storing said analysis data form which said characteristic has been removed and said sound parameter;

data reproduction means for reading out said analysis data and said sound parameter from said storage means and adding to the read-out analysis data a processed characteristic corresponding to the sound parameter; and sound synthesizer means for synthesizing a sound waveform on the basis of said analysis data to which said processed characteristic has been added.

19. A sound waveform synthesizer as defined in claim 18 which further comprises modification means for modifying said sound parameter, and wherein said data reproduction means adds to said analysis data said processed characteristic corresponding to the sound parameter modified by said modification means, to thereby control a sound to be synthesized.

20. A sound waveform synthesizer as defined in claim 19 wherein said modification means can modify said sound parameter in response to a user's operation.

21. A sound waveform synthesizer as defined in claim 18 wherein said data reproduction means includes interpolation means for interpolating between said analysis data corresponding to at least two different sounds or sound portions and also interpolates between the sound parameters concerning said at least two different sounds or sound portions, said data reproduction means adding a characteristic corresponding to the interpolated sound parameter to the interpolated analysis data.

22. A sound waveform synthesizer as defined in claim 18 wherein said analysis data contain data of a deterministic waveform component indicative of frequencies and magnitudes of partials that make up the waveform of the original sound, and stochastic data corresponding to a residual waveform component of said waveform of the original sound.

23. A sound waveform synthesizer comprising:

storage means for storing waveform analysis data containing data indicative of sound partials, and a sound parameter indicative of a characteristic concerning a predetermined sound element extracted from an original sound;

readout means for reading out said waveform analysis data and said sound parameter from said storage means;

control means for performing a control to modify the sound parameter read out from said readout means;

data modification means for modifying the read-out waveform data with the controlled sound parameter; and sound synthesizer means for synthesizing a sound waveform on the basis of the waveform analysis data modified by said data modification means.

24. A sound waveform synthesizer as defined in claim 23 wherein said waveform analysis data stored in said storage means further contain spectral envelope data, and wherein said sound synthesizer means comprises;

deterministic waveform generation means for generating a waveform of each partial on the basis of said data indicative of the sound partials contained in said waveform analysis data;

stochastic waveform generation means for generating a stochastic waveform which has a stochastic spectral structure having spectral magnitudes determined on the basis of the spectral envelope data contained in said waveform analysis data; and means for synthesizing a sound waveform by combining the waveform of each said sound partial and the stochastic waveform.

25. A sound waveform synthesizer comprising:

first means for providing spectral analysis data obtained from a spectral analysis of an original sound;

second means for detecting a formant structure from said spectral analysis data to thereby generate parameters describing the detected formant structure; and third means for subtracting the detected formant structure from said spectral analysis data to thereby generate residual spectral data, a waveform of an original sound being represented by a combination of said residual spectral data and said parameters.

26. A sound waveform synthesizer as defined in claim 25 which further comprises fourth means for variably controlling said parameters in order to control the formant, and fifth means for reproducing a formant structure on the basis of said parameters and adding the reproduced formant structure to the residual spectral data to thereby make completed spectral data having a controlled formant structure.

27. A sound waveform synthesizer as defined in claim 26 which further comprises sound synthesizer means for synthesizing a sound waveform on the basis of the completed spectral data made by said fifth means.

28. A sound waveform synthesizer as defined in claim 25 wherein said first means provides spectral analysis data for individual time frames obtained by analyzing said original sound at different time frames, said second means detects a formant structure for each said time frame on the basis of said spectral data for each said time frame to thereby generate parameters describing the detected formant structure, and said third means subtracts from the spectral analysis data for each said time frame the formant structure detected for each said time frame, to thereby generate residual spectral data for each said time frame.

29. A sound waveform synthesizer as defined in claim 25 wherein said second means includes means for, on the basis of magnitudes of each line spectrum in said spectral analysis data, detecting one or more hills assumed to be a formant from two local minima and one local maximum surrounded by the minima, and means for performing an approximation of a formant envelope by a predetermined function approximation for each of the detected hills and thereby obtaining formant parameters containing data that describe at least a center frequency and a peak level of the detected formant.

30. A sound waveform synthesizer as defined in claim 29 wherein said approximation of the formant envelope is performed by an exponential function approximation.

31. A sound waveform synthesizer as defined in claim 29 wherein said approximation of the formant envelope is performed by an isosceles triangle approximation.

32. A sound waveform synthesizer comprising:

first means for providing a set of partial data indicative of plural sound portions obtained by an analysis of an original sound, each of the partial data containing frequency data, said set of partial data being provided in time functions;

second means for detecting a vibrato in the original sound from the time functions of the frequency data in the partial data to thereby generate parameters describing the detected vibrato; and third means for removing a characteristic of the detected vibrato from the time functions of the frequency data in the partial data so as to generate time functions of modified frequency data, a time-varying waveform of the original sound being represented by a combination of the partial data containing the time functions of the modified frequency data and the parameters.

33. A sound waveform synthesizer as defined in claim 32 which further comprises:

fourth means for variably controlling said parameters in order to control the vibrato; and fifth means for generating a vibrato function on the basis of said parameters and utilizing the generated vibrato function to impart a vibrato to the time functions of the modified frequency data, a sound waveform being synthesized on the basis of the partial data containing the time functions of the frequency data to which the vibrato has been imparted.

34. A sound waveform synthesizer as defined in claim 32 wherein said second means detects the vibrato by a spectral analysis of the time functions of the frequency data, and said third means removes a component of the detected vibrato from time-function spectral data obtained by the spectral analysis of the time functions of the frequency data and inverse-Fourier transforming said time-function spectral data to thereby generate the time functions of the modified frequency data.

35. A sound waveform synthesizer as defined in claim 34 wherein said second means detects the vibrato by performing said spectral analysis on the time functions of one or more predetermined lower-order partials.

36. A sound waveform synthesizer comprising:

first means for providing a set of partial data indicative of plural sound portions obtained by an analysis of an original sound, each of the partial data containing magnitude data, said set of partial data being provided in time functions;

second means for detecting a tremolo in the original sound from the time functions of the magnitude data in the partial data so as to generate parameters describing the detected tremolo; and third means for removing a characteristic of the detected tremolo from the time functions of the frequency data in the partial data so as to generate time functions of modified magnitude data, a time-varying waveform of the original sound being represented by combination of the partial data containing the time functions of the modified magnitude data and the parameters.

37. A sound waveform synthesizer as defined in claim 36 which further comprises:

fourth means for variably controlling said parameters in order to control the tremolo; and fifth means for generate a tremolo function on the basis of said parameters and utilizing the generated tremolo function to impart a tremolo to the time functions of the modified frequency data, a sound waveform being synthesized on the basis of the partial data containing the time functions of the magnitude data to which the tremolo has been imparted.

38. A sound waveform synthesizer comprising:

first means for providing spectral data indicative of a spectral structure of an original sound;

second means for, on the basis of said spectral data, detecting only one tilt line that corresponds to a spectral envelope of the spectral data and generating a tilt parameter describing the detected tilt line;

third means for variably controlling said tilt parameter in order to control a spectral tilt;

fourth means for controlling the spectral structure of the spectral data on the basis of the controlled tilt parameter; and sound synthesis means for synthesizing a sound waveform on the basis of the spectral data.

39. A sound waveform synthesizer as defined in claim 38 wherein said first means provides the spectral data of each time frame obtained by analyzing the original sound at different time frames, and said second means detects the tilt line for each time frame on the basis of the spectral data for each time frame and generates only one tilt parameter indicative of a correlation between the tilt lines on the basis of data indicative of the tilt lines, and which further comprises fifth means for utilizing the tilt parameter to normalize said spectral data for each time frame, said fourth means for cancelling a normalized state of the normalized spectral data on the basis of the controlled tilt parameter.

40. A sound waveform synthesizer comprising:

first means for providing spectral data of partials making up an original sound, said spectral data of the partials being provided in correspondence to plural time frames;

second means for detecting an average pitch of the original sound on the basis of frequency data in the spectral data of the partials in a series of the time frames, to thereby generate pitch data;

third means for variably controlling said pitch data;

fourth means for modifying the frequency data of the spectral data of the partials in accordance with the modified pitch data; and sound synthesizer means for synthesizing a sound waveform having the variable controlled pitch on the basis of the spectral data of the partials containing the modified frequency data.

41. A sound waveform synthesizer as defined in claim 40 wherein said first means further provides stochastic data corresponding to a residual component waveform which is a result of subtracting from the original sound a deterministic component waveform corresponding to said spectral data of the partials, and said fourth means further controls a frequency characteristic of said stochastic data in accordance with the controlled pitch data.

42. A sound waveform synthesizer as defined in claim 40 which further comprises means for converting the frequency data in the spectral data of the partials into relative values based on the detected average pitch, said fourth means converting the relative values into absolute values in accordance with the controlled pitch data, to thereby obtain the modified frequency data.

43. A sound waveform synthesizer as defined in claim 40 wherein said second means obtains a frame pitch for each time frame by averaging frequencies of a plurality of predetermined lower-order partials after weighting in accordance with magnitudes of the partials and averages the frame pitch for each time frame to detect an average pitch.

44. A sound waveform synthesizer comprising:

storage means for storing spectral data of partials making up an original sound, stochastic data corresponding to a residual component waveform which is a result of subtracting from the original sound a deterministic component waveform corresponding to said spectral data of the partials, and pitch data indicative of a specified pitch of the original sound, each frequency data in the spectral data of the partials being represented in a relative value based on said specified pitch indicated by the pitch data;

means for reading out the data stored in said storage means;

control means for variably controlling said pitch data read out from said storage means;

operation means for converting the relative values of the frequency data in the spectral data of the partials which are read out from said storage means, into absolute values in accordance with the controlled pitch data; and sound synthesizer means for synthesizing partial waveforms on the basis of the converted frequency data and magnitude data in the spectral data of the partials read out from said storage means, and synthesizing said residual component waveform on the basis of said stochastic data read out from said storage means, to thereby synthesize a sound waveform by a combination of said partial waveforms and said residual component waveform.

45. A sound waveform synthesizer as defined in claim 44 wherein said spectral data of the partials stored in said storage means contain phase data, said phase data representing a phase of each of the partials in a relative value based on a phase of a fundamental partial, and which further comprises means for converting the relative values of the phase data in the spectral data of the partials read out from said storage means, said sound synthesizer means synthesizing said partial waveforms on the basis of the converted phase data, the frequency data and the magnitude data.

46. A sound waveform synthesizer comprising:

a closed waveguide network modeling a waveguide, said waveguide network for introducing an excitation function signal thereinto and performing on the signal a process that is determined by parameters for simulating a delay and reflection of the signal in the waveguide, to thereby synthesize a sound signal; and excitation function generation means for generating said excitation function signal, said excitation function signal generation comprising:

storage means for storing spectral data of partials making up an original sound, and stochastic data corresponding to a residual component waveform which is a result of subtracting from the original sound a deterministic component waveform corresponding to said spectral data of the partials;

means for reading out the data stored in said storage means;

control means for variably controlling said data read out from said storage means; and waveform synthesizer means for synthesizing partial waveforms on the basis of said spectral data of the partials, and synthesizing said residual component waveform on the basis of said stochastic data, to thereby synthesize a waveform signal by a combination of said partial waveforms and said residual component waveform, the synthesized waveform signal being supplied to said waveguide network as said excitation function signal.

47. A sound waveform synthesizer as defined in claim 46 wherein said storage means further stores a parameter indicative of a characteristic concerning a predetermined sound element, and said control means variably controls said parameter and also variably controls said spectral data of the partials and said stochastic data.

48. A method of analyzing and synthesizing a sound, comprising the steps of:

providing spectral data of partials making up an original waveform in series corresponding to plural time frames;

detecting a vibrato variation in said original waveform from a spectral data series of plural time frames and thereby making a data list that points out one or more waveform segments having a duration corresponding to at least one cycle of the vibrato variation;

selecting a desired waveform segment with reference to said data list;

extracting a spectral data series corresponding to the selected waveform segment, from said spectral data series of the original waveform;

repeating the extracted spectral data series and thereby making a spectral data series corresponding to repetition of the waveform segment; and synthesizing a sound waveform having an extended duration utilizing the spectral data series corresponding to said repetition.

49. A method of analyzing and synthesizing a sound as defined in claim 48 which further comprises the steps of:

providing, in series corresponding to the plural time frames, stochastic data corresponding to a residual component waveform that is a result of subtracting from said original waveform a deterministic component waveform corresponding to said spectral data of the partials;

extracting a stochastic data series corresponding to said selected waveform segment, from a stochastic data series of said original waveform;

repeating the extracted stochastic data series and thereby making a stochastic data series corresponding to repetition of the waveform segment; and synthesizing a sound waveform having an extended duration utilizing the stochastic data series corresponding to said repetition, and incorporating the synthesized stochastic waveform into said sound waveform.

50. A method of analyzing and synthesizing a sound, comprising the steps of:

providing spectral data of partials making up an original waveform in series corresponding to plural time frames;

detecting a vibrato variation in said original waveform from a spectral data series of the plural time frames and thereby making a data list that points out one or more waveform segments having a duration corresponding to at least one cycle of the vibrato variation;

selecting a desired waveform segment with reference to said data list;

removing a spectral data series corresponding to the selected waveform segment, from a spectral data series of the original waveform and connecting two spectral data series which remain before and after the removed spectral data series to thereby make a shortened spectral data series; and synthesizing a sound waveform having a shortened duration, utilizing the shortened spectral data series.

51. A method of analyzing and synthesizing a sound as defined in claim 50 which further comprises the steps of:

providing, in series corresponding to the plural time frames, stochastic data corresponding to a residual component waveform that is a result of subtracting from said original waveform a deterministic component waveform corresponding to said spectral data of the partials;

removing a stochastic data series corresponding to the selected waveform segment, from a stochastic data series of the original waveform and connecting two stochastic data series which remain before and after the removed series to thereby make a shortened stochastic data series; and synthesizing a stochastic waveform having a shortened duration utilizing the shortened stochastic data series, and incorporating the synthesized stochastic waveform into said sound waveform.

* * * * *